US011898318B1

(12) United States Patent
MacKarvich

(10) Patent No.: US 11,898,318 B1
(45) Date of Patent: Feb. 13, 2024

(54) SUPPORT SYSTEM FOR PREMANUFACTURED BUILDINGS

(71) Applicant: Charles J. MacKarvich, Atlanta, GA (US)

(72) Inventor: Charles J. MacKarvich, Atlanta, GA (US)

( * ) Notice: Subject to any disclaimer, the term of this patent is extended or adjusted under 35 U.S.C. 154(b) by 0 days.

(21) Appl. No.: 18/375,021

(22) Filed: Sep. 29, 2023

Related U.S. Application Data

(60) Provisional application No. 63/412,159, filed on Sep. 30, 2022.

(51) Int. Cl.

| | |
|---|---|
| ***E04B 1/34*** | (2006.01) |
| ***E02D 27/02*** | (2006.01) |
| ***E02D 27/48*** | (2006.01) |
| ***E04B 1/343*** | (2006.01) |

(52) U.S. Cl.
CPC ..... *E02D 27/02* (2013.01); *E02D 27/48* (2013.01); *E04B 1/34352* (2013.01)

(58) Field of Classification Search
CPC ..... E02D 27/02; E02D 27/48; E04B 1/34352
See application file for complete search history.

(56) References Cited

U.S. PATENT DOCUMENTS 4,417,426 A * 11/1983 Meng ..... E04B 1/34352 52/167.3
4,914,875 A * 4/1990 Gustafson ..... E04B 1/34352 52/126.6
5,697,191 A 12/1997 MacKarvich
5,850,718 A * 12/1998 MacKarvich ..... E02D 27/02 52/695
5,983,573 A 11/1999 MacKarvich
6,058,663 A * 5/2000 MacKarvich ..... E02D 27/48 52/167.3
6,243,998 B1 * 6/2001 MacKarvich ..... E04B 1/34352 52/167.3
6,343,449 B1 2/2002 MacKarvich
6,381,907 B1 * 5/2002 MacKarvich ..... E04B 1/34352 52/126.6
6,546,686 B2 * 4/2003 MacKarvich ..... E02D 27/02 248/680
6,634,150 B1 10/2003 Oliver et al.
7,140,157 B2 11/2006 Oliver et al.
7,526,899 B1 5/2009 Oliver et al.
8,919,060 B1 * 12/2014 Oliver ..... E02D 27/48 405/230
11,421,415 B2 * 8/2022 Blevins ..... E04B 1/34352
2001/0000842 A1 * 5/2001 MacKarvich ..... E02D 27/02 52/155
2002/0095880 A1 7/2002 MacKarvich
2003/0213197 A1 * 11/2003 Oliver ..... E04B 1/34352 52/274
2022/0064933 A1 * 3/2022 Blevins ..... E02D 27/50

* cited by examiner

*Primary Examiner* — Adriana Figueroa
(74) *Attorney, Agent, or Firm* — Taylor English Duma LLP

(57) ABSTRACT

A support device for a premanufactured structure can include a support platform; a connector coupled to the support platform with a device fastener, the device fastener configured to adjust, upon tightening, a connector offset distance defined between the connector and the support platform; and a plurality of struts coupled to the connector and configured to be coupled to the premanufactured structure, each of the plurality of struts coupled to the connector and configured to transfer a portion of the weight of the premanufactured structure to the support platform via the connector.

33 Claims, 26 Drawing Sheets

SUPPORT SYSTEM FOR PREMANUFACTURED BUILDINGS

REFERENCE TO RELATED APPLICATIONS

This application claims the benefit of U.S. Provisional Application No. 63/412,159, filed Sep. 30, 2022, which is hereby specifically incorporated by reference herein in its entirety.

TECHNICAL FIELD

Field of Use

This disclosure relates to support structures for supporting the weight of a premanufactured building when installed at an installation site. More specifically, this disclosure relates to structures for adjustably supporting the weight of the premanufactured building by adjustment with a tool.

Related Art

Premanufactured buildings are typically constructed at a central location and transported to a permanent installation site. The typical premanufactured building structure comprises a base, which can comprise beams (e.g., a pair of parallel horizontal 1-beams) and a building structure mounted on top of the beams. The beams are typically placed at the side edges of the building structure. After the building has been constructed, wheels are temporarily mounted to the base so that the building structure can be towed to the installation site.

When the premanufactured building arrives at the installation site, concrete support platforms are typically formed in the ground, and static piers are typically positioned on the platforms. The static piers can be adjusted for proper height, and the building structure can then be lowered onto the piers. Wedges, shims, or other fine adjustment devices can be urged between the piers and the beams as an attempt to have all of the piers support approximately the same proportional load of the building structure.

The adjustment of each pier is difficult in that an installer typically does not know and cannot easily discern how much weight each pier supports. For example, a single pier might ideally support a portion of the premanufactured building weighing 2000 lbs. However, visual observation of the building structure and the pier will not typically reveal the load applied by the building to each pier. Some downward settling of the building structure may occur at a pier supporting a larger load than an adjacent pier.

In the past, when a premanufactured building experienced some settling after installation, the settling can be detected and remedied by placing wedges or shims between the piers and the beams where needed. However, even after detection and remediation, it is not likely that the piers will each support approximately equal amounts of the load from the building structure, and additional settling of the building structure might still occur.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a support device for a premanufactured structure, the support system comprising: a support platform; a connector coupled to the support platform with a device fastener, the device fastener configured to adjust, upon tightening, a connector offset distance defined between the connector and the support platform; and a plurality of struts coupled to the connector and configured to be coupled to the premanufactured structure, each of the plurality of struts coupled to the connector and configured to transfer a portion of the weight of the premanufactured structure to the support platform via the connector.

In a further aspect, disclosed is a support system comprising: a plurality of support devices configured to fully support the weight of a premanufactured structure, each of the plurality of support devices comprising: a support platform; a connector coupled to the support platform with a device fastener, the device fastener configured to adjust, upon tightening, a connector offset distance defined between the connector and the support platform; and a plurality of struts coupled to the connector and configured to be coupled to the premanufactured structure.

In yet another aspect, disclosed is a method of using a support system for a premanufactured structure, the method comprising: placing a support device on ground beneath a load-carrying portion of a frame of the premanufactured structure, the support device comprising: a support platform; a connector coupled to the support platform with a device fastener; a plurality of struts coupled to the connector; and adjusting an effective height of the support device to increase or decrease loading on the support device by adjusting, upon tightening of the device fastener, a connector offset distance defined between the connector and the support platform.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 1A:
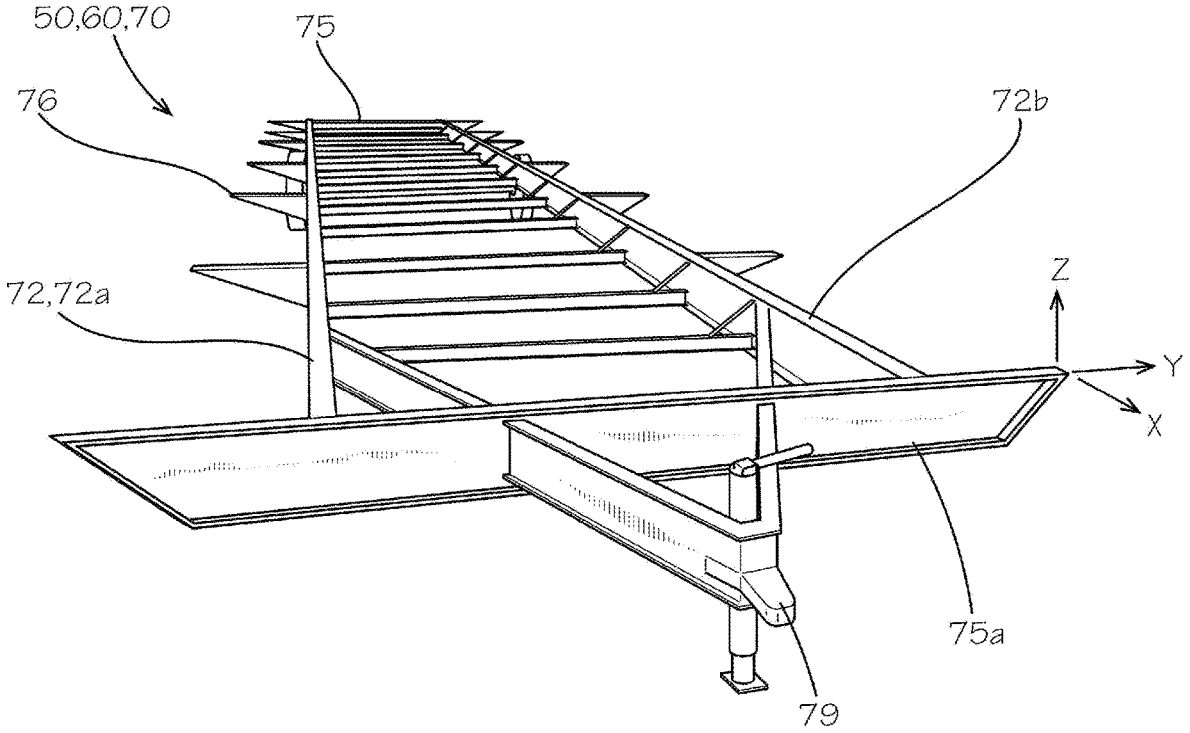
FIG. 1A is a top perspective view of a base of a premanufactured building in accordance with one aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list. The phrase "at least one of A and B" as used herein means "only A, only B, or both A and B"; while the phrase "one of A and B" means "A or B."

As used herein, unless the context clearly dictates otherwise, the term "monolithic" in the description of a component means that the component is formed as a singular component that constitutes a single material without joints or seams.

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that end of a premanufactured structure (e.g., a premanufactured home) or a support structure for same nearest to and occupied by a longitudinal end of the premanufactured structure and, more specifically, a longitudinal end configured to be connected to a tow vehicle for transport of the premanufactured structure; "rear" is that end of the seat that is opposite or distal the front; "left" is that which is to the left of or facing left from a person in the premanufactured structure and facing towards the front; and "right" is that which is to the right of or facing right from that same person while in the premanufactured structure and facing towards the front. "Horizontal" or "horizontal orientation" or "horizontal direction" describes that which is in a plane extending from left to right and aligned with the horizon. "Vertical" or "vertical orientation" or "vertical direction" describes that which is in a plane that is angled at 90 degrees to the horizontal.

The support system can also be described using a coordinate axis of X-Y-Z directions shown in FIG. 1A. A Y-axis direction can be referred to as a left-right or transverse direction. An X-axis direction can be referred to as a front-rear direction or longitudinal direction. An upper-lower direction is a Z-axis direction orthogonal to the X-axis direction and to a Y-axis direction. The Y-axis direction is orthogonal to the X-axis direction (left-right direction) and the Z-axis direction (upper-lower direction).

In some aspects, a support system and associated methods, systems, devices, and various apparatuses are disclosed herein. In some aspects, the support system can comprise a support apparatus or support device. In some aspects, the support device can comprise a connector, a support platform, and a plurality of struts coupled to the support platform with the connector.

The support system can support a premanufactured building or, more generally, a premanufactured structure or just a structure with adjustable support devices, each of which can be a pier, albeit mechanically adjustable with a tool, and can be adjustable in a vertical direction to bear more or less of a load constituting or resulting from the premanufactured building. In some aspects, the structures and method disclosed herein can provide lightweight but strong foundation for a structure that adjusts for a distance between the structure and a supporting ground surface with, at most, a simple hand tool.

FIG. 1A is a top perspective view of a base 60 of a structure 50 (e.g., a premanufactured building) in accordance with one aspect of the current disclosure. In some aspects, the base 60 can support something other than the premanufactured building. In some aspects, the structure 50 can be a premanufactured home, which can be a mobile home. In some aspects, the premanufactured building can be used for any suitable purpose such as, for example and without limitation, living quarters, an office, a classroom, or a clinic. In some aspects, the structure 50 can comprise a superstructure (not shown) and the base 60. The superstructure can define any one or more of a wall, a floor, and a ceiling.

The base 60 can comprise or define a frame 70, which can comprise one or more longitudinal members, lateral members, and/or other members. As shown, the frame 70 can comprise a beam 72, which can be a joist. More specifically, the frame 70 can comprise a pair of beams 72*a,b*. The beam 72 can comprise a vertical portion or web 172 and one or more horizontal portions or flanges 174. The beam 72 can be or can comprise, for example and without limitation, an I-beam. The beams 72*a,b* and, as shown, other portions of the frame 70 can be parallel to each other. The beams 72*a,b* and, more generally, the frame 70 can extend horizontally. Each of the beams 72*a,b* can comprise The beams 72*a,b* and, more generally, the frame 70 can be rectilinear. The frame 70 can comprise cross-members 75, which can extend in a lateral direction between the beams 72*a,b* or from a first beam 72*a* to a second beam 72*b*. One or more of the cross members 75 can be a beam 75*a*. The frame 70 can comprise a cantilever support 76. The frame can comprise a transport coupling 79, which can comprise a tow fitting configured to be coupled to a vehicle able to transport the frame 70 and, more generally, the premanufactured structure 50. The frame 70 can comprise or can be configured to receive wheels (not shown) to facilitate movement of the frame and, more generally, the premanufactured structure 50 across a distance such as, for example and without limitation, a distance from a manufacturing facility to an installation site. As described elsewhere herein, the frame 70 can be a load-carrying frame.

In some aspects, the beam 72*a,b* and, more generally, the frame 70 can be supported in part on and by one or more static or stationary piers. In some aspects, the beams 72*a,b* can be supported in part on and by a support system 80 (shown in FIG. 1B) and, more specifically, one or more support devices 100 (shown in FIG. 1B), which can be adjustable as disclosed herein.

Figure 1B:
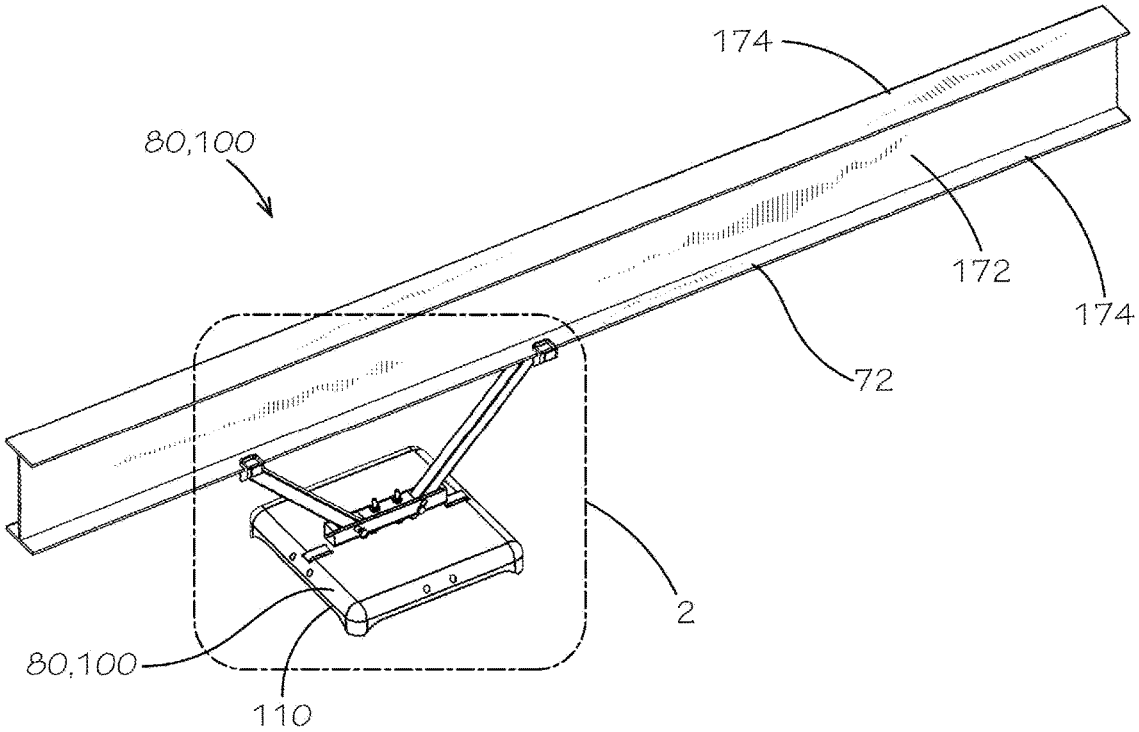
FIG. 1B is a top perspective view of a longitudinal beam of the base of FIG. 1B and a support device in accordance with one aspect of the current disclosure.

FIG. 1B is a top perspective view of the longitudinal beam 72 of the base of FIG. 1B and the support system 80, which can comprise the support device 100, in accordance with one aspect of the current disclosure. The support device 100 can comprise a support platform 110, which can be configured to engage ground 40 (shown in FIG. 6A) beneath the structure 50 (shown in FIG. 1A) and, more specifically, beneath the frame 70 (shown in FIG. 1A) of the base 60 (shown in FIG. 1A). In some aspects, the support platform 110 can be configured to remain stationary in a longitudinal direction of the support system 80 once engaged with the ground 40. In some aspects, the support platform 110 can be configured to remain stationary in a lateral direction of the support system 80 once engaged with the ground 40. In some aspects, the support platform 110 can be configured to remain stationary in both a longitudinal direction and a lateral direction of the support system 80 once engaged with the ground 40.

Figure 2:
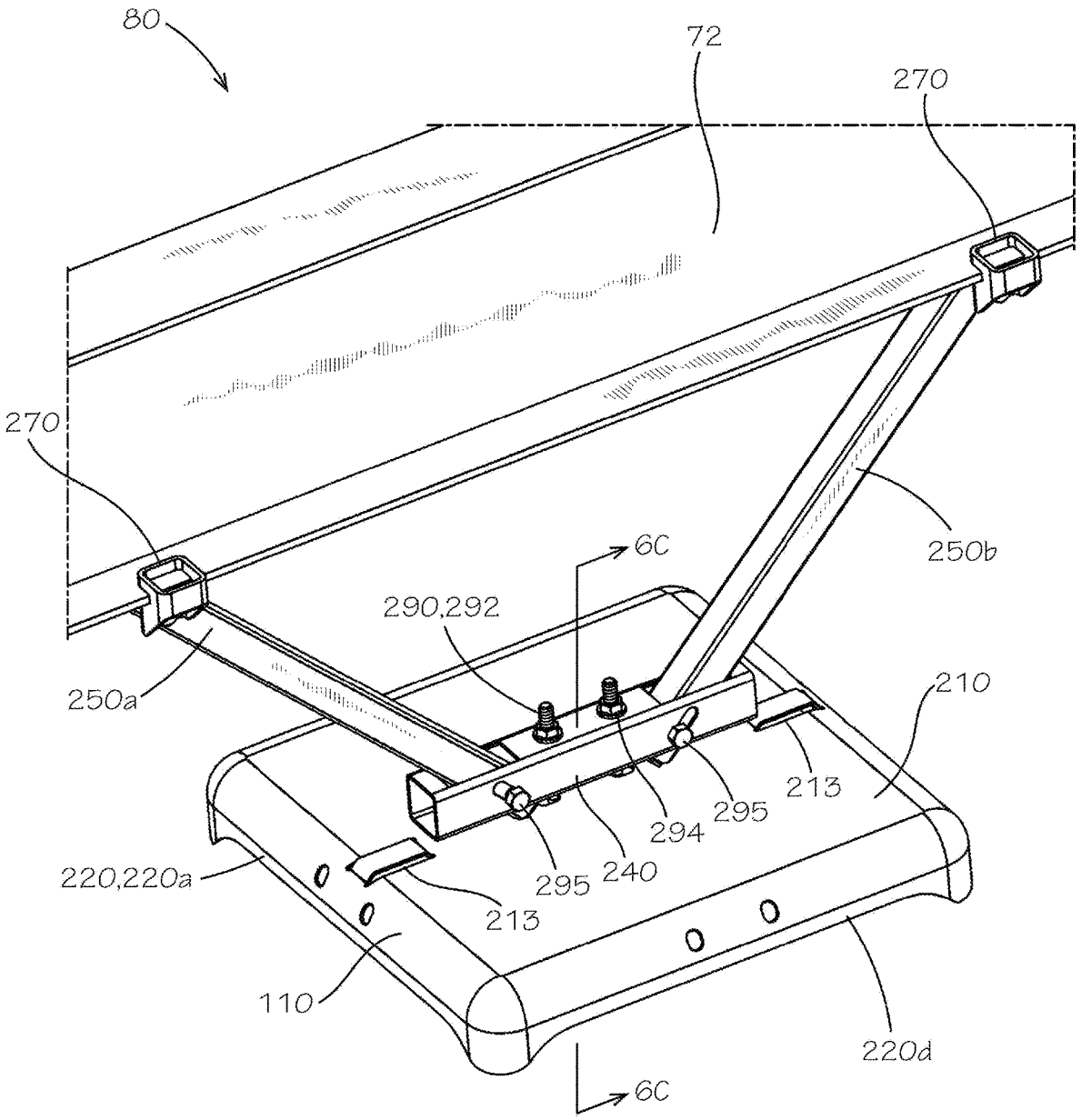
FIG. 2 is a top perspective view of the longitudinal beam of the base and the support device of FIG. 1B taken from detail 2 of FIG. 1B.

FIG. 2 is a top perspective view of the longitudinal beam 72 of the base 60 and the support device 100 of FIG. 1B taken from detail 2 of FIG. 1B. The support platform 110 can comprise a first portion or main portion 210, which can be a main panel. The first portion 210 can define a planar or substantially planar surface. The support platform 110 can comprise a second portion or secondary portion 220, which can comprise one or more flanges 220*a,b,c,d* (220*b,c* shown in FIG. 6A). The second portion 220 can be angled with respect to the first portion 210. More specifically, a surface of the second portion 220 (e.g., the flanges 220*a,b,c,d*) can be angled at 90 degrees with respect to the first portion 210. The flanges 220*a,b,c,d* can be configured to penetrate the ground 40 beneath the support platform 110 to provide lateral and longitudinal stability for the support platform 110. In some aspects, the second portion 220 and, more specifically, the flanges 220*a,b,c,d* can be formed by straight bending of separate flanges of a flat blank. In some aspects, the second portion 220 and, more specifically, the flanges 220*a,b,c,d* can be mechanically drawn (i.e., mechanically formed using a drawing process from a flat blank) or otherwise formed from a flat blank, and as shown the flanges 220*a,b,c,d* need not be separated but can be directly joined to each other at corners of the support platform 110. The support platform can define radii at an intersection between the first portion 210 and the second portion 220.

The support platform 110 can define a receiver 213, which can be configured to receive within or about a strap such as a lateral strut or strut 750 (shown in FIG. 7A) of the support device 100. In some aspects, the receiver 213 can be formed or defined in the support platform 110. In some aspects, the receiver 213 can be formed integrally with or, more specifically, monolithically from a material forming a surrounding portion of the support platform. The receiver 213 can define a slot, which can be sized to receive the lateral strut 750. The receiver 213 can slideably receive the lateral strut 750 and can secure the lateral strut 750 therein. In some aspects, a fastener can secure the lateral strut 750 in or about the receiver 213.

The support device 100 can comprise a connector 240, which can be coupled to the support platform 110. In some aspects, the connector 240 can be coupled to the support platform 110 with one or more device fasteners or fasteners 290. In some aspects, as shown, the fastener 290 can comprise a first portion 292, which can be a U-bolt defining two ends. Each of the ends of the first portion 292 can be threaded and otherwise configured to receive a second portion 294, which can be a threaded fastener such as, for example and without limitation, a nut and, more specifically, a flanged nut as shown or a nut-and-washer combination. The connector 240 can define one or more openings through which the one or more fasteners 290 can be engaged. In some aspects, as shown, an axis of the fastener 290 can be angled with respect to the horizontal or with respect to the support platform 110 and, more specifically, a main portion 210 thereof. In some aspects, as also shown, an axis of the fastener 290 can be angled 90 degrees with respect to the horizontal or with respect to the support platform 110 and, more specifically, a main portion 210 thereof.

The support device 100 can comprise a plurality of struts 250*a,b*. More specifically, the support device 100 can comprise a pair of struts 250*a,b*. Each of the plurality of struts 250*a,b* can be coupled to the connector 240. Each of the plurality of struts 250*a,b* can be configured to transfer a portion of the weight of the structure 50 to the support platform 110 via the connector 240. Each of the plurality of struts 250*a,b* can be coupled to the connector 240 via a corresponding strut fastener or fastener 295*a,b*, which can be any threaded or non-threaded fastener such as, for example and without limitation, a bolt or a pin. Each of the struts 250*a,b* can be angled with respect to the vertical by an angle 257 (shown in FIG. 6A) and with the horizontal by an angle 258 (shown in FIG. 6A).

The support device 100 can comprise one or more clamps 270, each of which can be coupled to each of the plurality of struts 250*a,b* and to the beam 72 of the structure 50. Each of the one or more clamps 270 can be configured to transfer a portion of the weight or load of the structure 50 to a corresponding strut 250*a,b* of the plurality of struts 250*a,b*.

Figure 3:
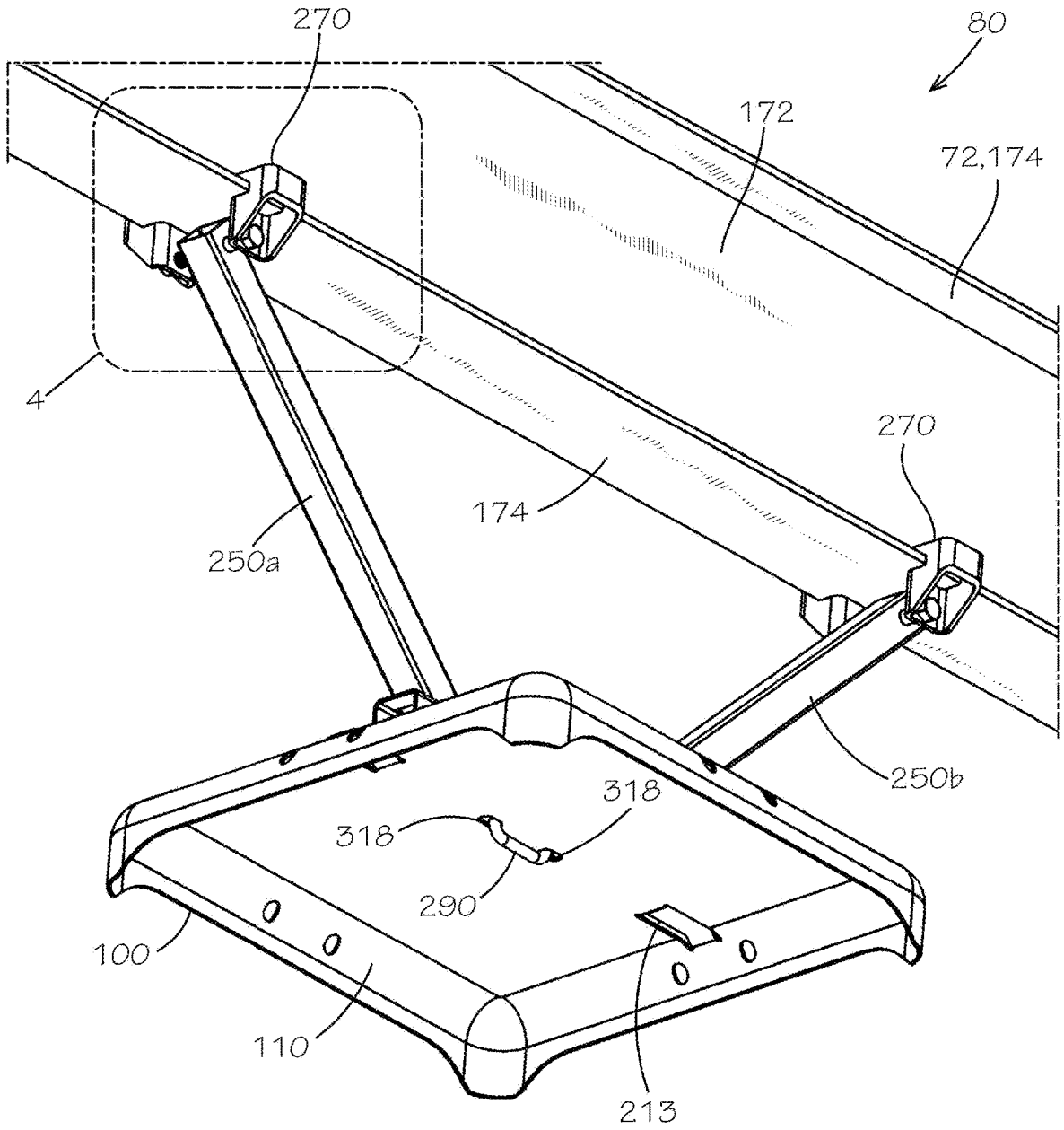
FIG. 3 is a bottom perspective view of the longitudinal beam of the base and the support device of FIG. 1B.

FIG. 3 is a bottom perspective view of the longitudinal beam 72 of the base 60 and the support device of FIG. 1B. As shown, the fastener 290 can extend though openings 318 defined in the support platform 110 and bear against the first portion 210 when the fastener 290 is engaged or tightened.

Figure 4:
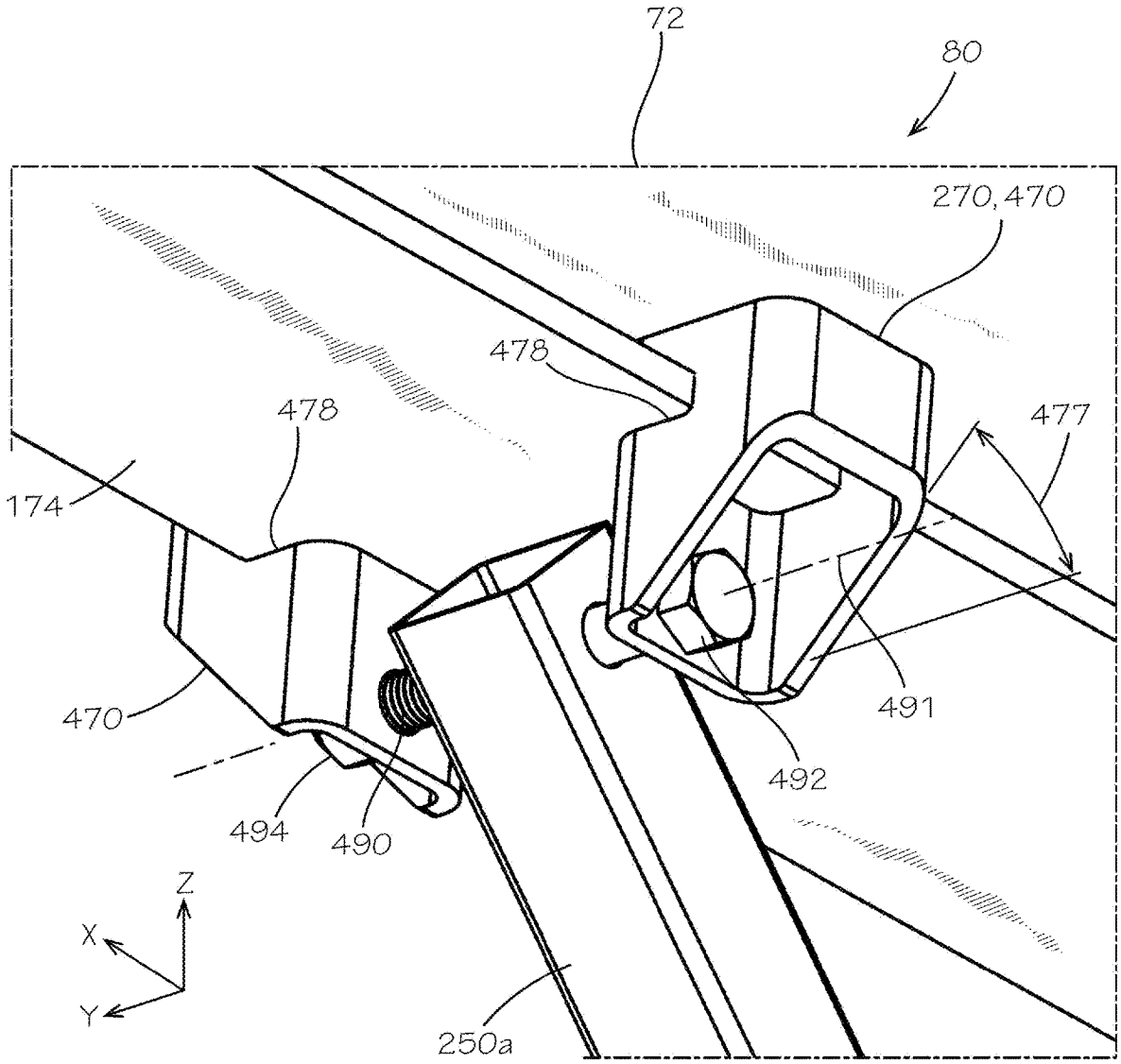
FIG. 4 is a detail bottom perspective view of a clamp of the support device of FIG. 1B where secured to the longitudinal beam of the base of FIG. 1B taken from detail 4 of FIG. 3.

FIG. 4 is a detail bottom perspective view of one of the clamps 270 of the support device 100 of FIG. 1B where secured to the longitudinal beam 72 of the base 60 of FIG. 1B taken from detail 4 of FIG. 3. Each clamp 270 can comprise one or more clamp bodies 470, which can be coupled to each other and through and to a strut such as the strut 250*a*. As shown, a clamp fastener or fastener 490 comprising a first portion 492 and a second portion 494 lockably secured to the first portion 492 can extend through and engage each of a pair of clamp bodies 470 and the strut 250*a*, which can be positioned between the clamp bodies 470. Upon tightening of the fastener 490, the clamp bodies 470 can tend to rotate and an engagement slot 478 of each clamp body 470, which can already be received about the flange 174 of the beam 72, can further engage the flange 174. Each clamp body 470 can be formed from a tube, as shown, and a surface of a lower end of the clamp body 470 can be angled with respect to a transverse, lateral, or Y-axis direction thereof by an angle 477 to facilitate access to the fastener 490. The fastener 490 itself can extend in the transverse, lateral, or Y-axis direction and can define a fastener axis 491 aligned with same.

Figure 5B:
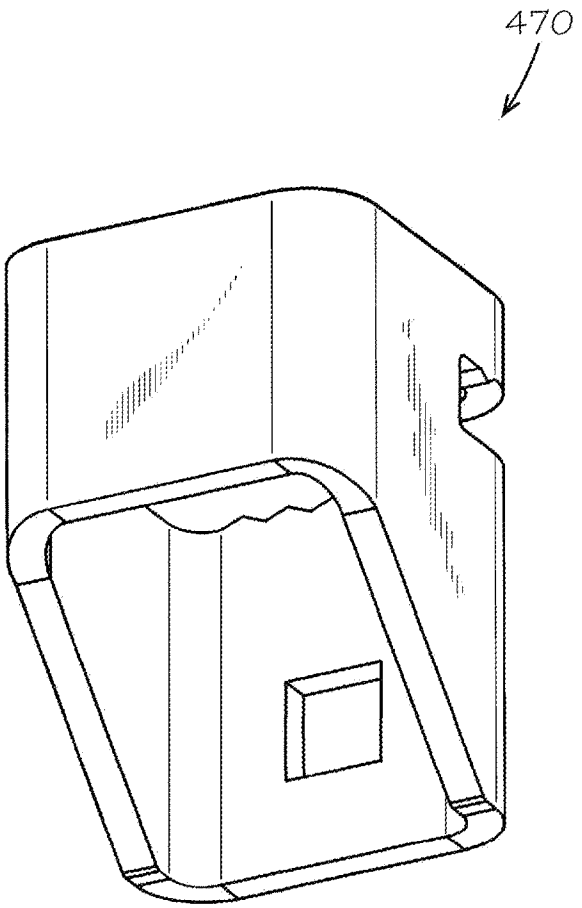
FIG. 5B is a bottom outside perspective view of the clamp body of FIG. 5A.
Figure 5A:
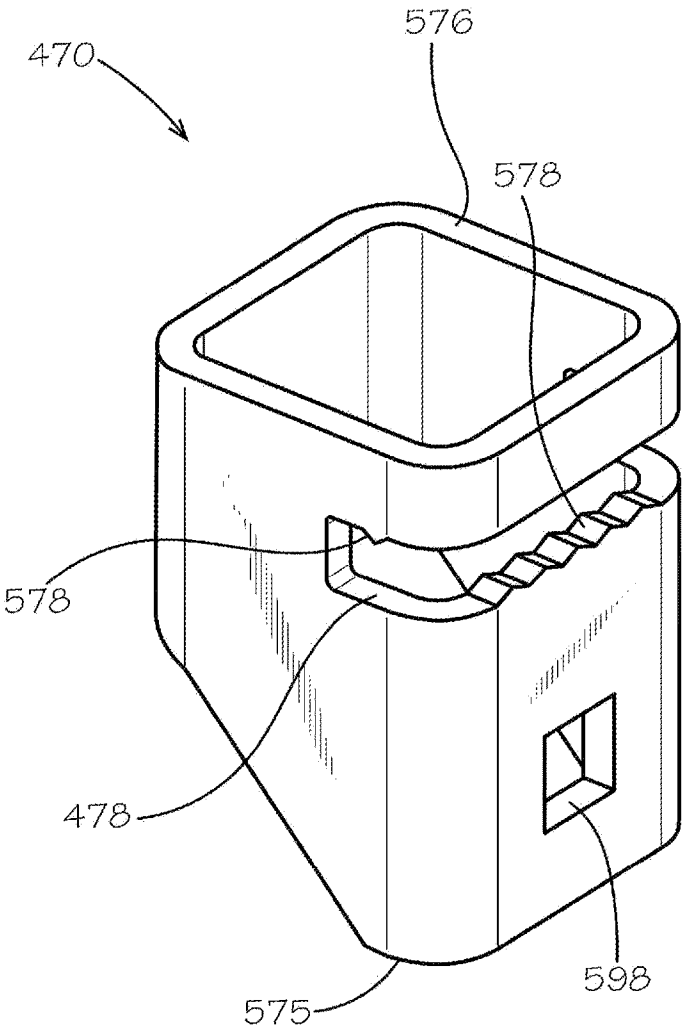
FIG. 5A is a top inside perspective view of a clamp body of the clamp of FIG. 4.
Figure 5D:
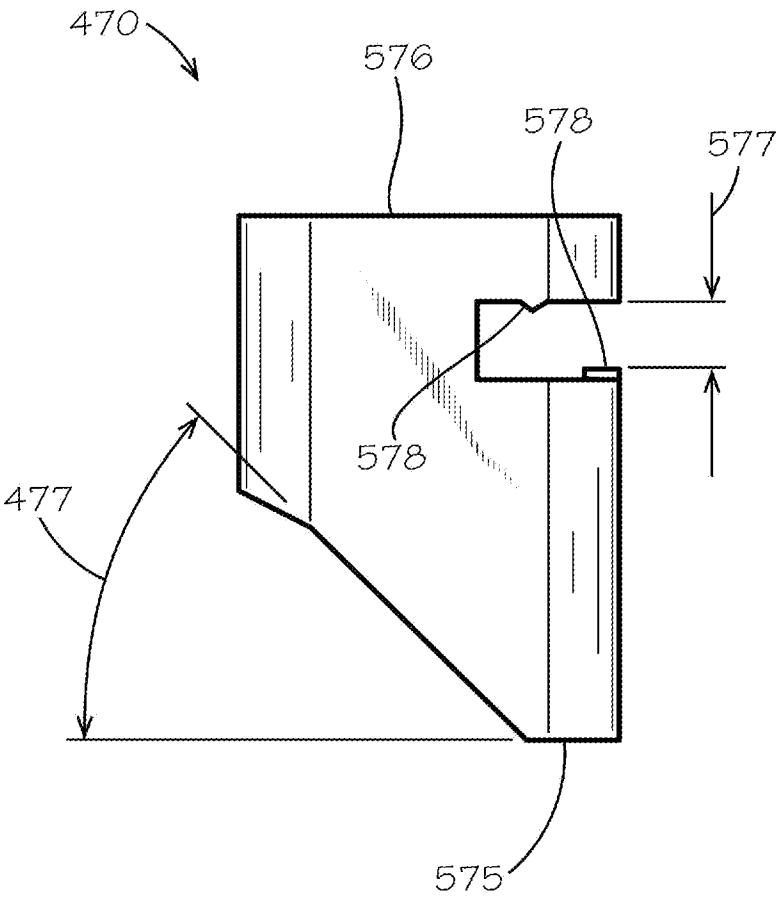
FIG. 5D is a side view of the clamp body of FIG. 5A.
Figure 5C:
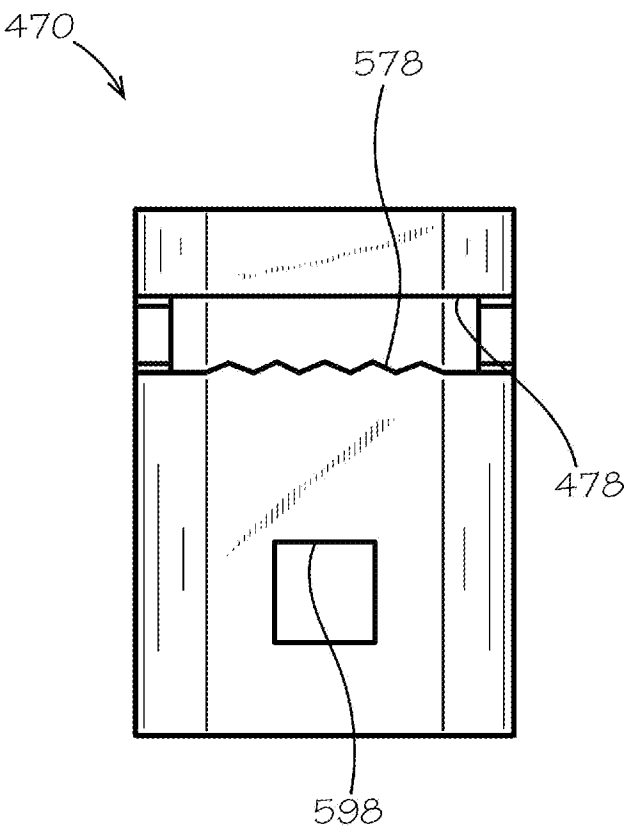
FIG. 5C is an inside or front view of the clamp body of FIG. 5A.

FIGS. 5A-5D are various views of the clamp body 470 of the clamp 270 of FIG. 4. More specifically, FIG. 5A is a top inside perspective view, FIG. 5B is a bottom outside perspective view, FIG. 5C is an inside or front view, and FIG. 5D is a side view of the clamp body 470. The clamp body 470 can define a first end or lower end 575 and a second end or upper end 576. A transverse or radial cross-section of the clamp body 470 can be constant from the first end 575 to the second end 576, except where the clamp body 470 is cut at the first end 575 and/or the second end 576. More specifically, the clamp body 470 can define a substantially rectangular or, more specifically, square cross-section throughout (i.e., square except for non-material deviations such as in the form of radii defined at the corners. A surface of the engagement slot 478 can define one or more teeth 578 therein. In some aspects, a lower surface (i.e., a surface of the engagement slot 478 closer to the first end 575 of the clamp body 470) can define the teeth 578. In some aspects, an upper surface (i.e., a surface of the engagement slot 478 closer to the second end 576 of the clamp body 470) can define one or more of the teeth 578. In some aspects, as shown, both the lower surface and the upper surface can define one or more of the teeth 578. The clamp body 470 can define a fastener opening 598, which can receive the fastener 490 (shown in FIG. 4). A height 577 of the engagement slot 478 can be made taller than a thickness of the flange 174 of the beam 72 to ease assembly and engagement of the clamp body 470 with the flange 174 and permit rotation of the clamp body 470 with respect to the flange 174. As shown in FIG. 5D, an angled cut in the clamp body 470 can, at least in part, vary from the angle 477.

Figure 5E:
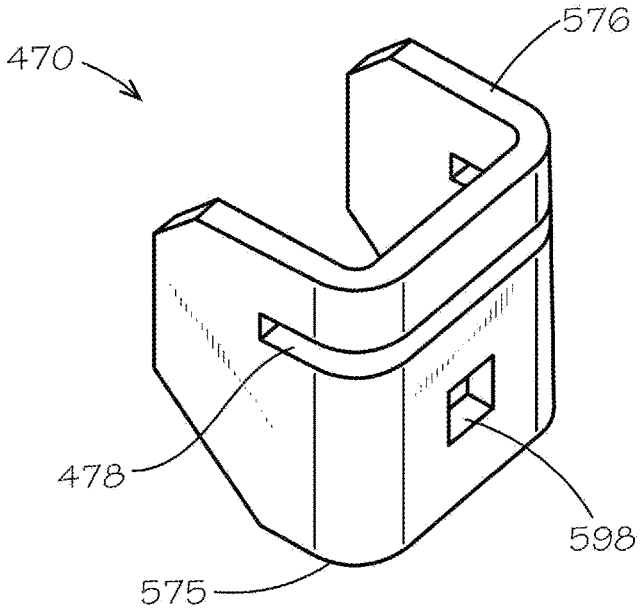
FIG. 5E is a top inside perspective view of the clamp body of FIG. 5A in accordance with another aspect of the current disclosure.

FIG. 5E is a top inside perspective view of the clamp body 470 of FIG. 5A in accordance with another aspect of the current disclosure. As shown and already noted above, the clamp body 470 and, more specifically, the engagement slot 478 need not define the teeth 578.

Figure 5F:
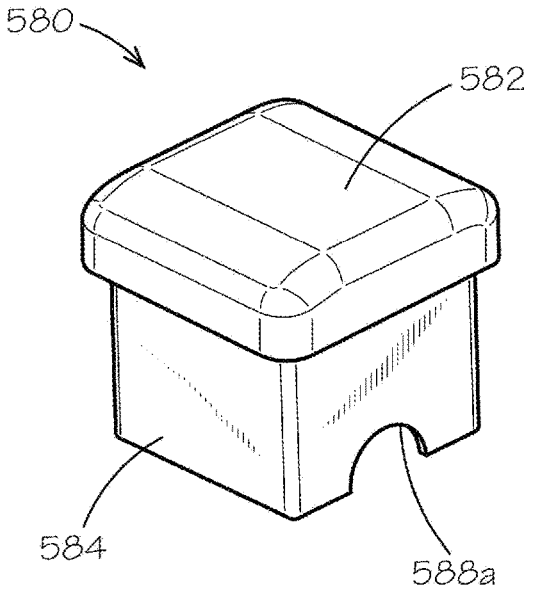
FIG. 5F is a top perspective view of a cap received within a first end of each strut of the support device of FIG. 7A.
Figure 5G:
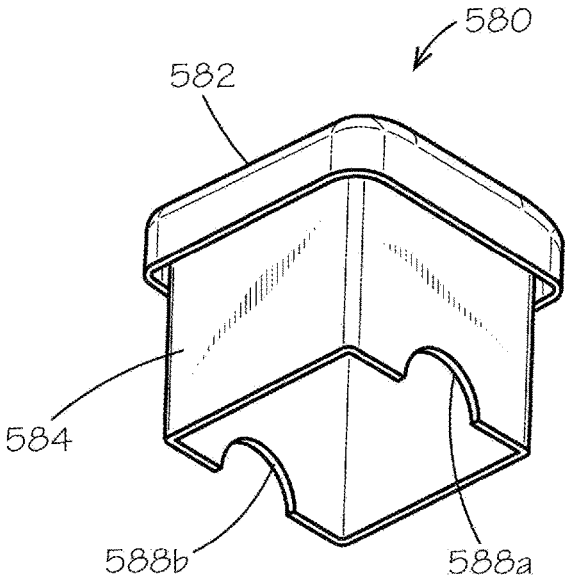
FIG. 5G is a bottom perspective view of the cap of FIG. 5F.

FIG. 5F is a top perspective view and FIG. 5G is a bottom perspective view of an end piece 580, which can be a plug or cap. In some aspects, a lower end or first end 255 of each strut 250*a,b* of the support device 100 of FIG. 7A can comprise the end piece 580. In some aspects, the end piece 580 can cap a lower end or first end 255 of each strut 250*a,b* of the support device 100 of FIG. 7A. In some aspects, the end piece 580 can, more specifically, be received within or about the first end 255. In some aspects, the end piece 580 can be otherwise secured to the first end 255. The end piece 580 can define a body 582. The end piece 580 can define an extension 584, which can be received within or about one of the struts 250*a,b* and can be hollow as shown. The end piece 580 and, more specifically, the extension 584 can define openings or notches 588*a,b*. In some aspects, the notches 588*a,b* can provide clearance for other components of the support system 80 such as, for example and without limitation, the fasteners 295 pinning the struts 250*a,b* proximate to the first ends 255 thereof.

Figure 6A:
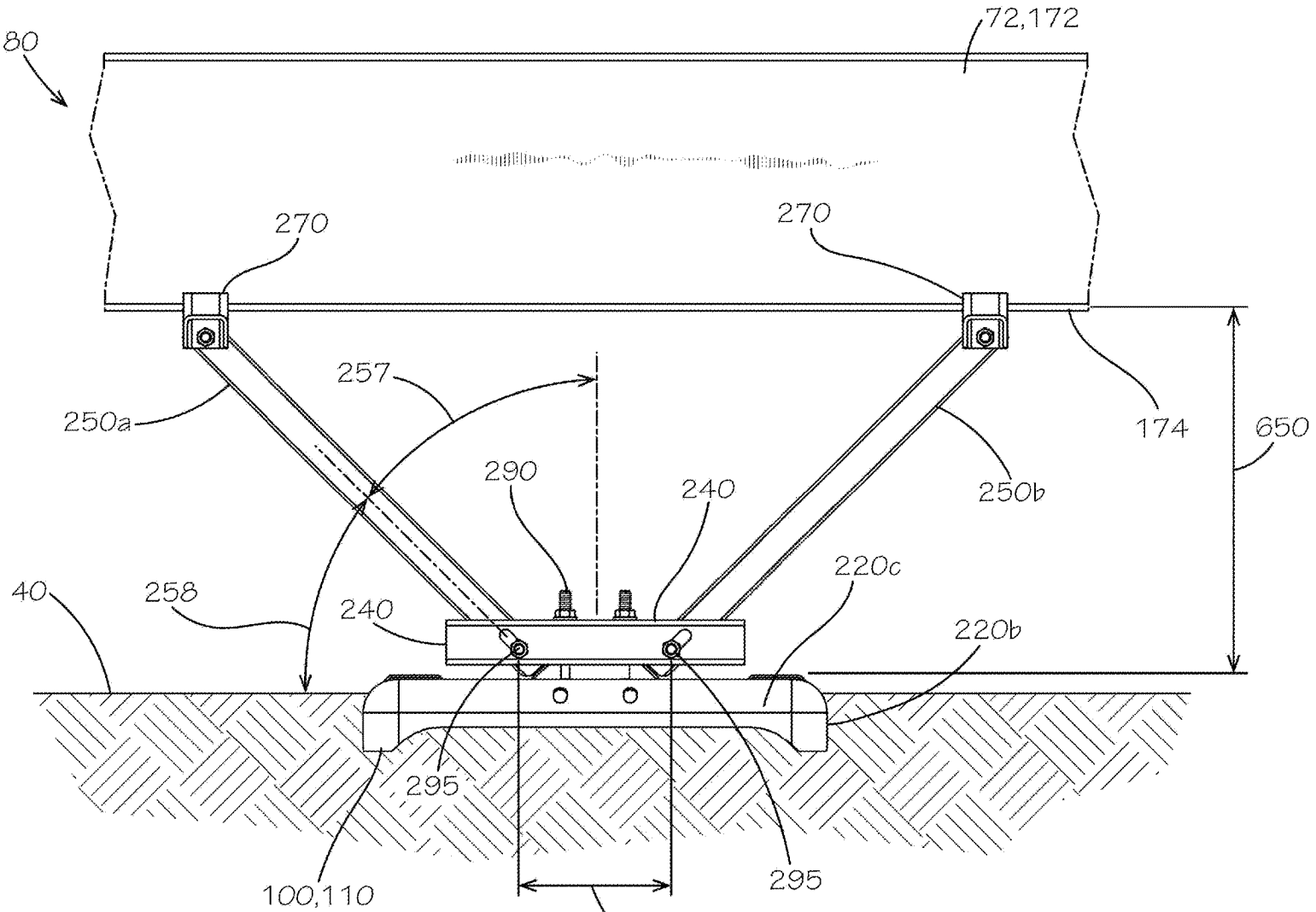
FIG. 6A is a partial sectional side view of the longitudinal beam of the base and the support device of FIG. 1B when installed in a ground surface below the base, with only the ground surface shown in cross-section.

FIG. 6A is a partial sectional side view of the longitudinal beam 72 of the base 60 (shown in FIG. 1A) and the support device 100 of FIG. 1B when installed in a surface of the ground 40 below the base 60. Again, the struts 250*a,b* can be oriented at sloped or oblique with respect to the support platform 110 and also with respect to the beam 72 to be supported. As shown, the lower end or first end 255 (shown in FIG. 6C) of each strut 250*a,b* can be coupled to the support platform 110 (e.g., via the connector 240), and an upper or second end 256 (shown in FIG. 6C) of each strut 250*a,b*, which can be distal from the first end 255, can be coupled to the beam 72 (e.g., via the clamp 270). At least one of the ends of each strut 250*a,b* can be adjustably supported so that the angles 257,258 of the slope of one or both of the struts 250*a,b* can be changed, thereby changing the vertical height of the corresponding strut(s) 250*a,b*. Each of the struts 250*a,b* can be rectilinear along its full length.

The lower or first end of each strut 250*a,b* can be received in the connector 240, which can be movably or floatably mounted to the support platform 110. Adjustment of a position of the connector 240 and, more importantly, the struts 250*a,b* can be made by adjustment of the one or more fasteners 290. More specifically, adjustment can be facilitated by the second portion 294 (e.g., a nut) of the fastener 290, movement of which can adjust the vertical position of the connector 240 with respect to the support platform 110.

Again, a pair of the struts 250*a,b* can be used in each support device 100. The struts 250*a,b* of each pair of the struts 250*a,b* can be sloped in opposed or opposite directions so that the horizontal forces applied through the struts 250*a,b* cancel each other. For example, as shown, the pair of struts can be formed in a "V" configuration, but as shown attachment points or hinge points of the lower ends or first ends 255 of the struts 250*a,b* can be separated by a strut spacing or strut offset distance or offset distance 670 in the longitudinal or X-axis direction. More specifically, the fasteners 295 can be offset from each other by the offset distance 670 in the longitudinal or X-axis direction. The offset distance 670 can permit alignment of the struts 250*a,b* in the same plane, can create space for the one or more fasteners 290 between the struts 250*a,b*, and/or can spread out the forces acting through the struts 250*a,b* due to the weight of the base 60 and, more generally, the structure 50 so that they are distributed across the support platform 110 and not concentrated at a single point on the support platform 110.

Figure 6B:
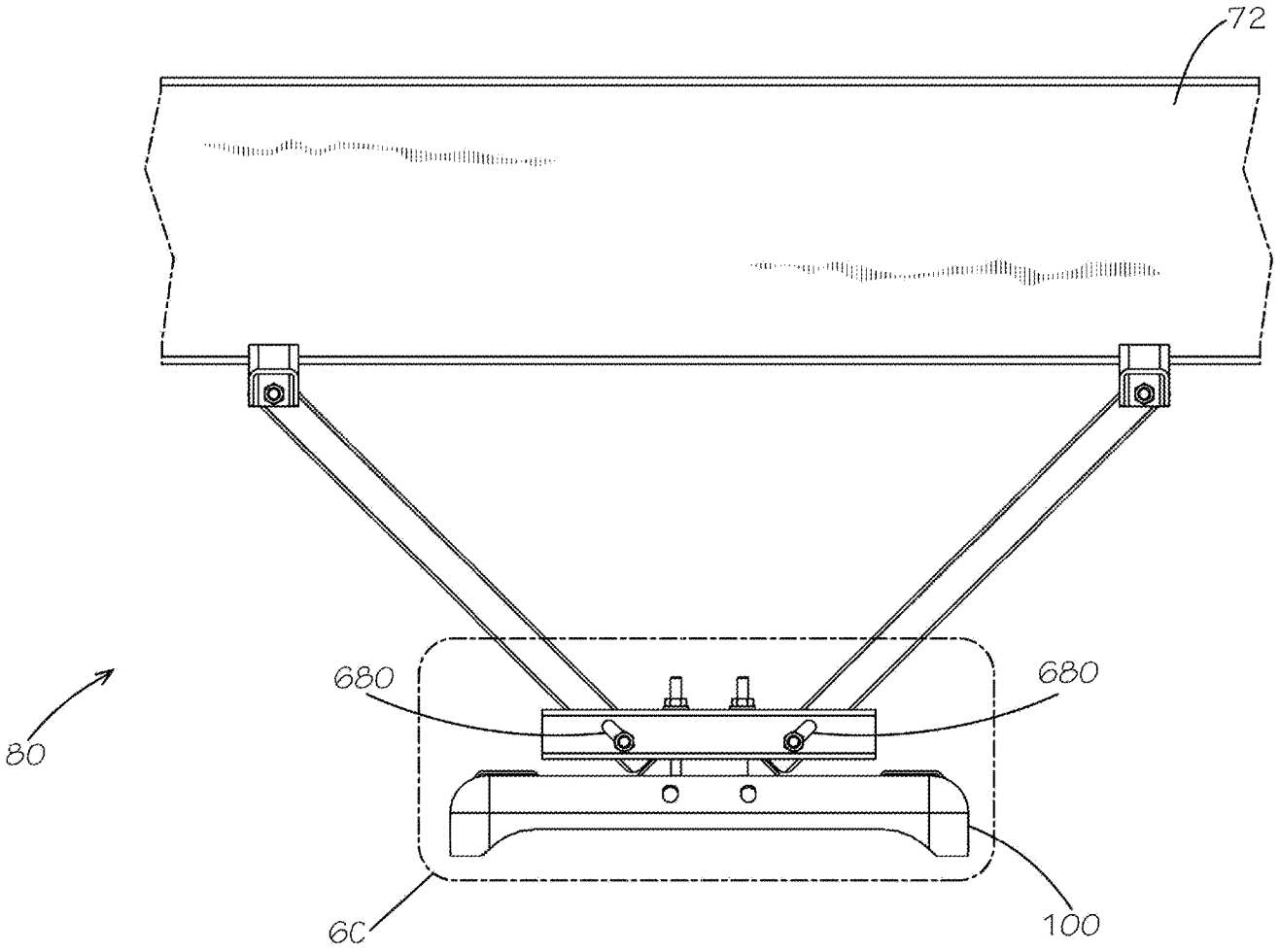
FIG. 6B is a side view of the longitudinal beam of the base and the support device of FIG. 6A.
Figure 6C:
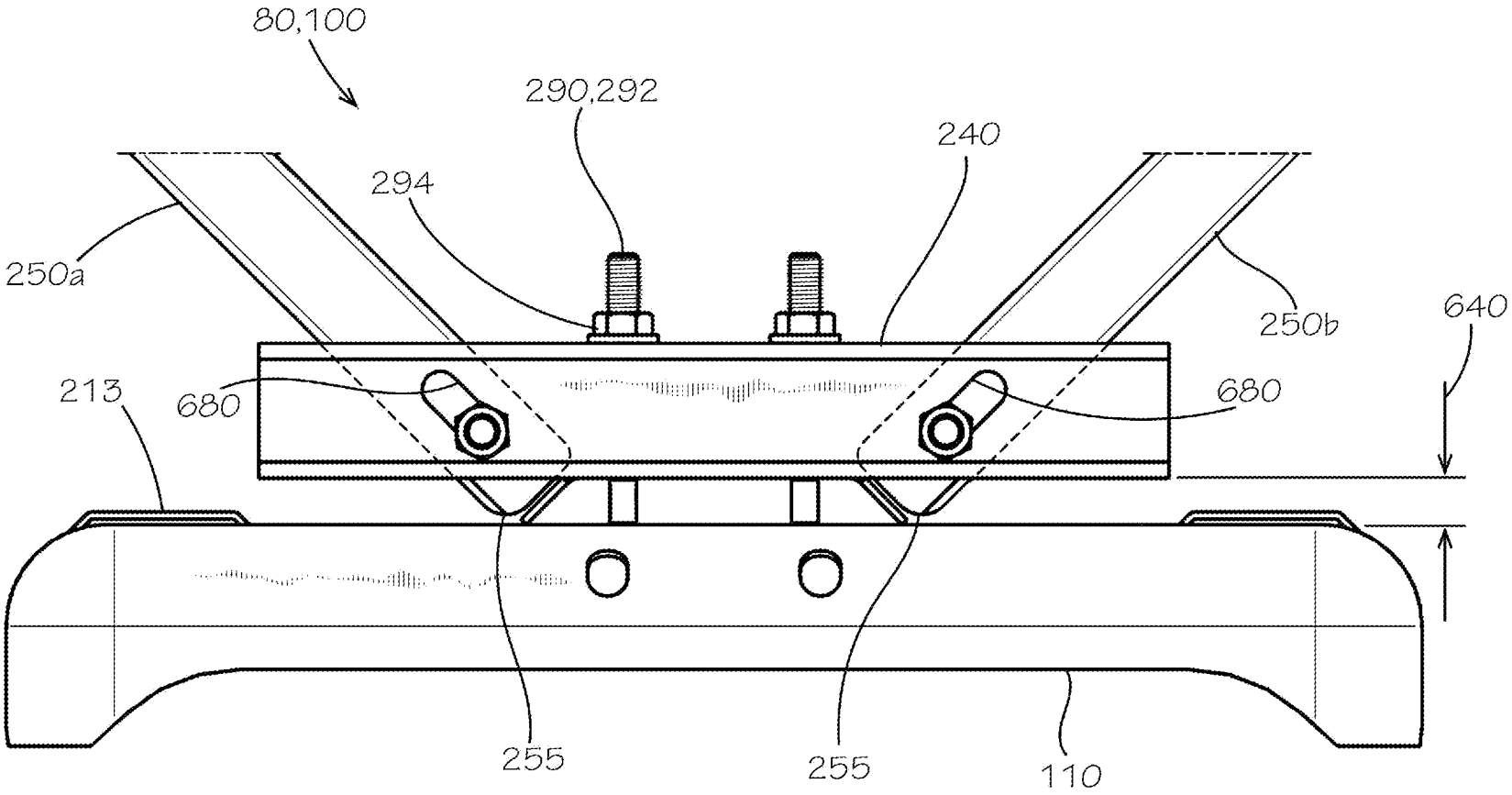
FIG. 6C is a side view of the support device of FIG. 6A taken from detail 6C of FIG. 6B.
Figure 6D:
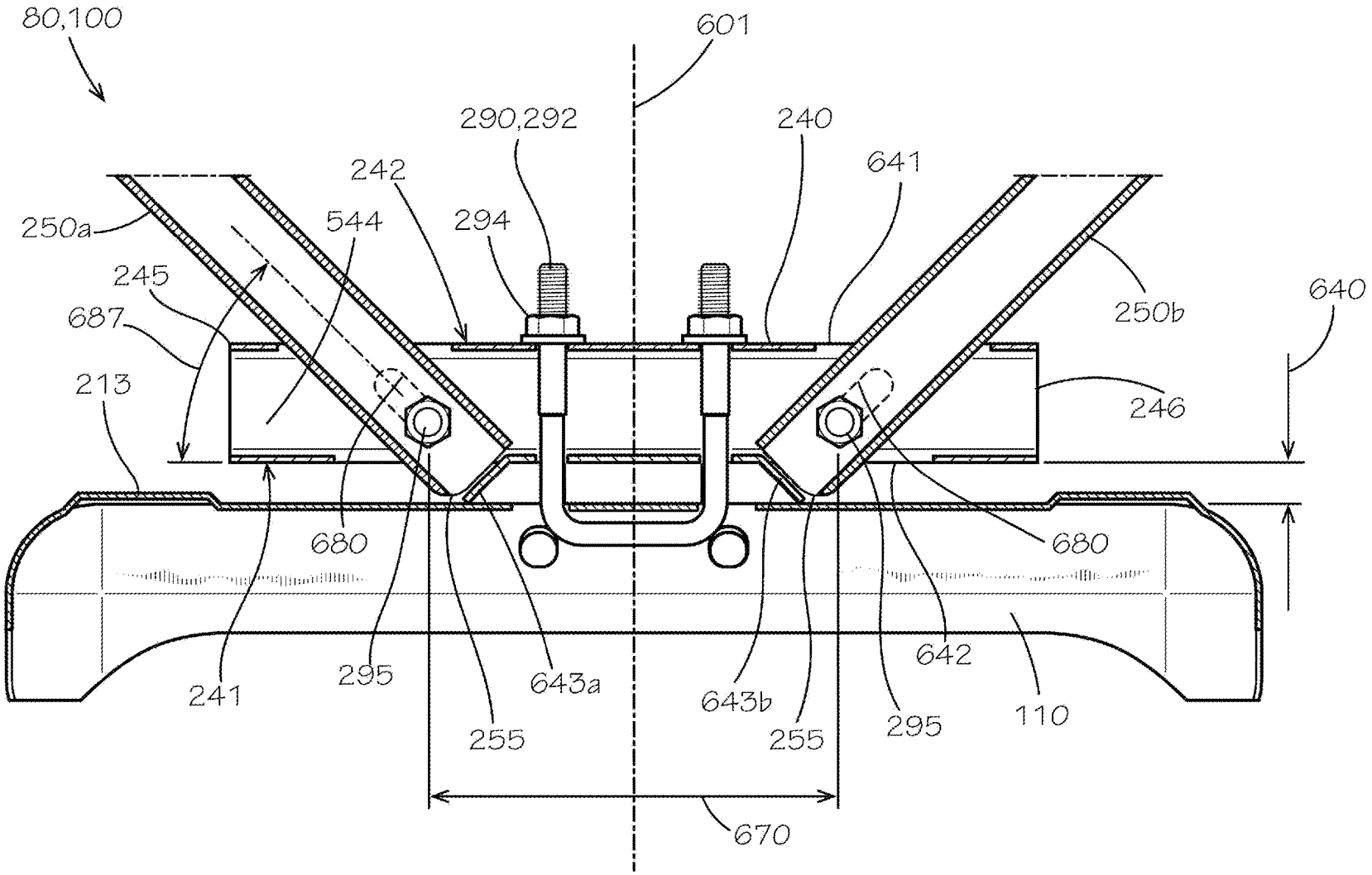
FIG. 6D is a sectional side view of the support device of FIG. 6A taken along line 6C-6C of FIG. 2.

FIG. 6B is a side view of the longitudinal beam 72 of the base 60 (shown in FIG. 1A) and the support device 100 of FIG. 6A, FIG. 6C is a side view of the support device 100 of FIG. 6A taken from detail 6C of FIG. 6B, and FIG. 6D is a sectional view of the support device 100 of FIG. 6A taken along line 6C-6C of FIG. 2. For clarity, the ground 40 is removed. As shown in FIG. 6C, like in FIG. 6A, a bottom surface of the connector 240 can be offset from a top surface of the support platform 110 by a connector offset distance 640 (shown in FIG. 6C), which can be measured in a vertical direction as shown.

As also shown in FIG. 6D, the connector 240 can define a first end 245 and a second end 246, which can be distal from the first end 245. The connector 240 can define openings 642 in an upper wall 542 defining an upper surface or second surface 242 and openings 641 in a lower wall 541 defining a lower surface or first surface 241 to receive the struts 250*a,b*. The connector 240 can further define side walls 544, each of which can define an outer surface 244 (shown in FIG. 7A). In some aspects, a portion of the material forming the connector 240 at the openings 641 can remain part of the connector 240 and can form tabs 643*a,b*, which can be bent with respect to the lower surface 241 and can support the first ends 255 of the struts 250*a,b*. The tabs 643*a,b* can facilitate assembly of the support device 100 and, for example, can position the first end 255 of the struts 250*a,b* for quick alignment and insertion of the fasteners 295. In some aspects, the tabs 643*a,b* are not required, and the struts 250*a,b* can more directly contact the support platform 110. As can be seen here and will be described in further detail below, tightening of the fastener 290 can reduce the connector offset distance 640. In some aspects in which the tabs 643*a,b* are present, tightening of the fastener 290 can flatten, i.e., unbend, the tabs 643*a,b* and permit further movement of the connector 240 as desired. In either case, tightening of the fastener 290 can move or adjust a position of one or both of the struts 250*a,b* by moving the fasteners 295 pinned and coupled to the corresponding struts 250*a,b* and to the connector 240. More specifically, such tightening of the fastener 290 can move each strut 250*a,b* and the corresponding fastener 295 along a corresponding aperture 680—or, as shown in FIG. 7E, a pair of apertures-defined in the connector 240. Upon tightening of the fastener 290, the fastener 295 and the first end 255 of the strut 250*a,b* pinned to the connector 240 by the fastener 295 can, more specifically, move away from a centerline 601 of the support device 100. Such movement or adjustment of the position of one or both of the struts 250*a,b* can adjust the fastener offset distance 670, can adjust the angles 257,258 (shown in FIG. 6A), and cause an effective height 650 (shown in FIG. 6A) of the support device 100 to increase and thereby cause the support device 100 to be able to carry or support a greater portion of the weight of the structure 50 (shown in FIG. 1A).

The aperture 680 can be angled with respect to the vertical and the horizontal. In some aspects, a centerline of the aperture 680 can be angled at an aperture angle 687 of 45 degrees with respect to the upper surface 242 and/or the lower surface 241 of the connector 240. In some aspects, the aperture angle 687 can be less than or equal to 60 degrees and more than or equal to 30 degrees. In some aspects, the aperture angle 687 can be less than or equal to 50 degrees and more than or equal to 40 degrees. The centerline of each aperture 680 can define a longitudinal direction of the aperture.

Again, in some aspects, as shown, the fastener 290 can comprise a U-bolt. In some aspects, each of a plurality of fasteners 290 can couple the connector 240 to the support platform 110 and can be separately adjusted. In some aspects, more than one connector 240 can be used, in which case each connector 240 can be coupled to the support platform 110 with one or more separate fasteners 290.

Figure 7A:
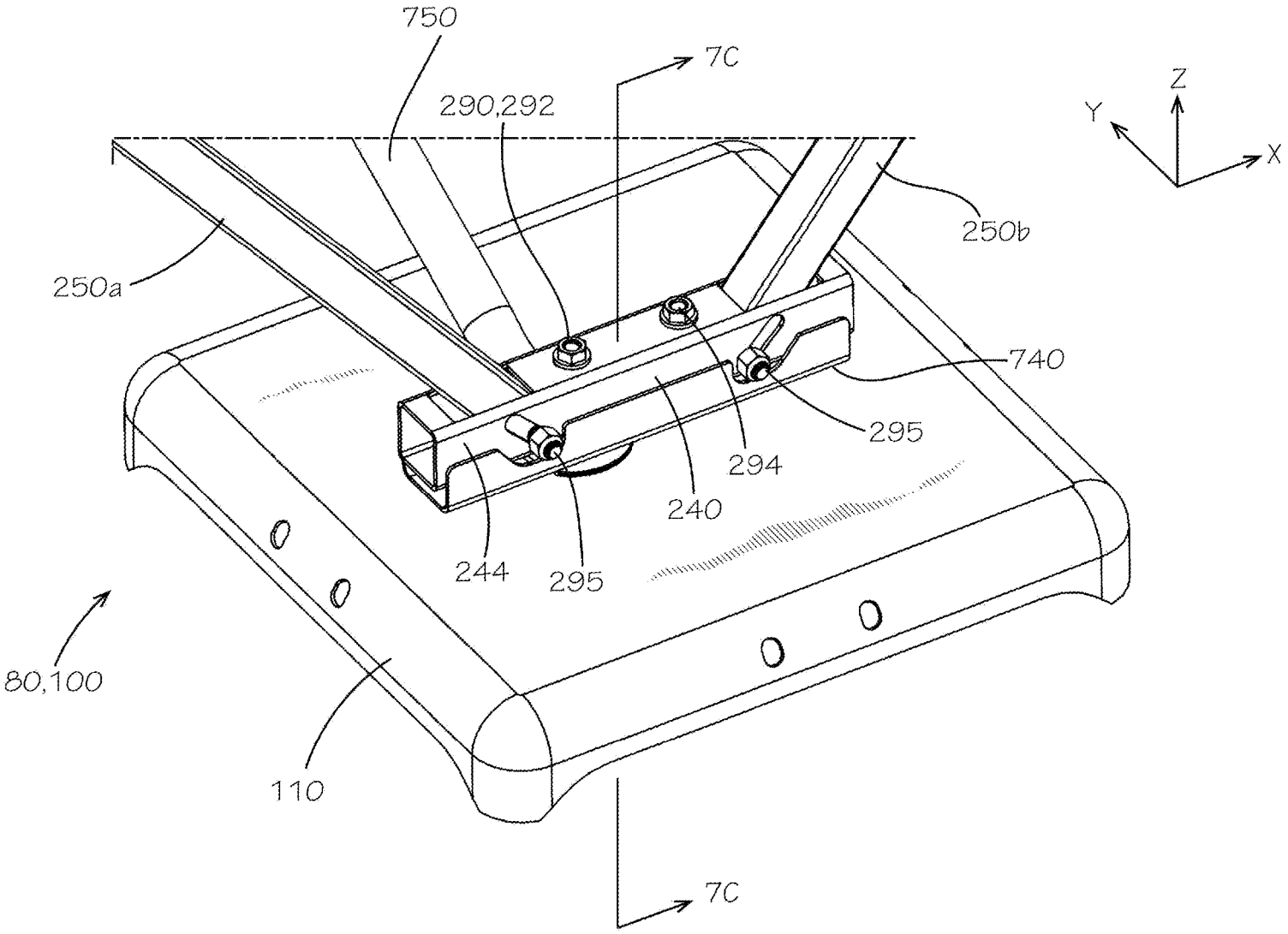
FIG. 7A is a top perspective view of the support device of FIG. 1B in accordance with another aspect of the current disclosure, the support device also comprising a lateral strut.
Figure 7B:
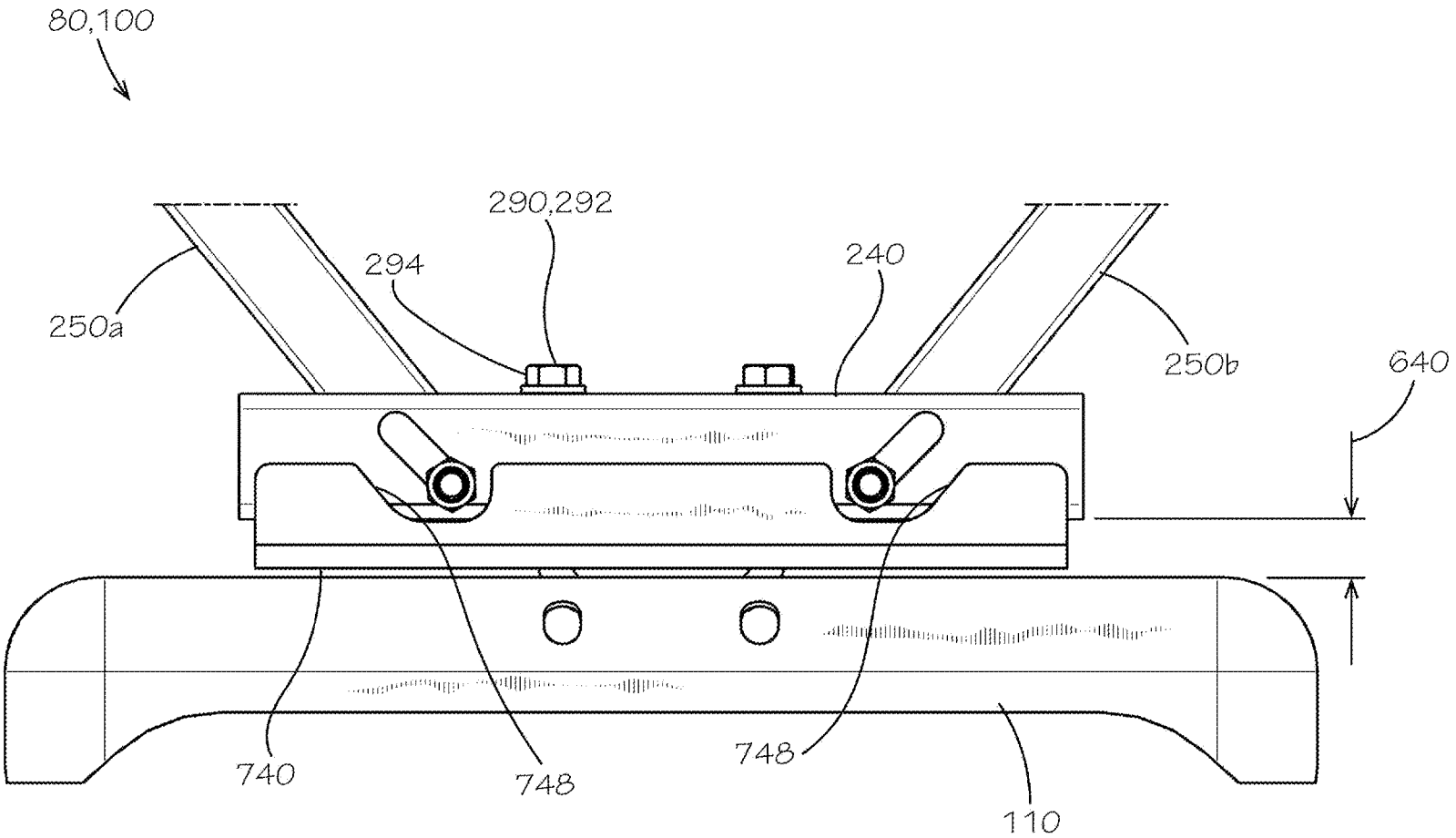
FIG. 7B is a side view of the support device of FIG. 7A.
Figure 7C:
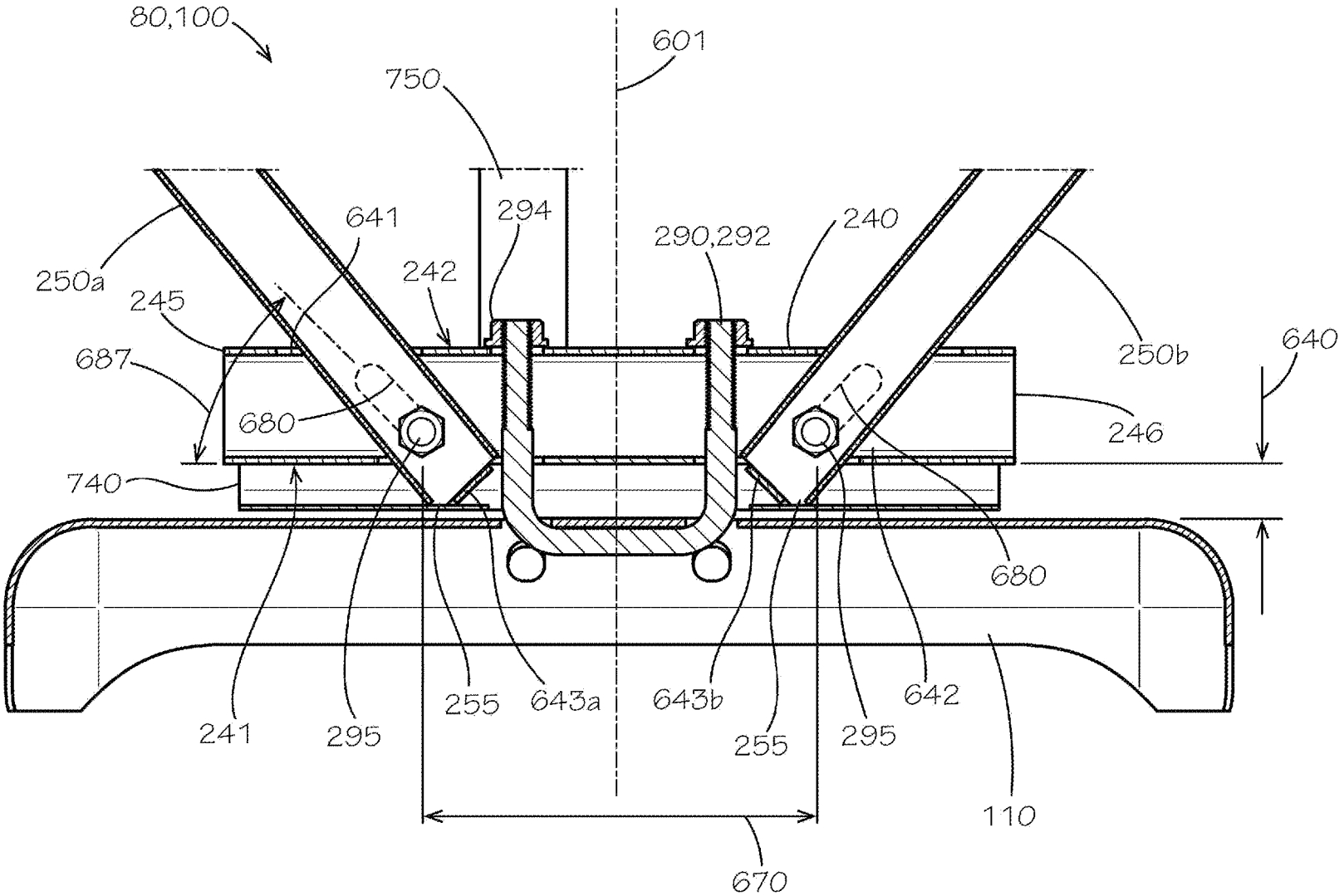
FIG. 7C is a sectional side view of the support device of FIG. 7A taken along line 7C-7C of FIG. 7A.
Figure 7D:
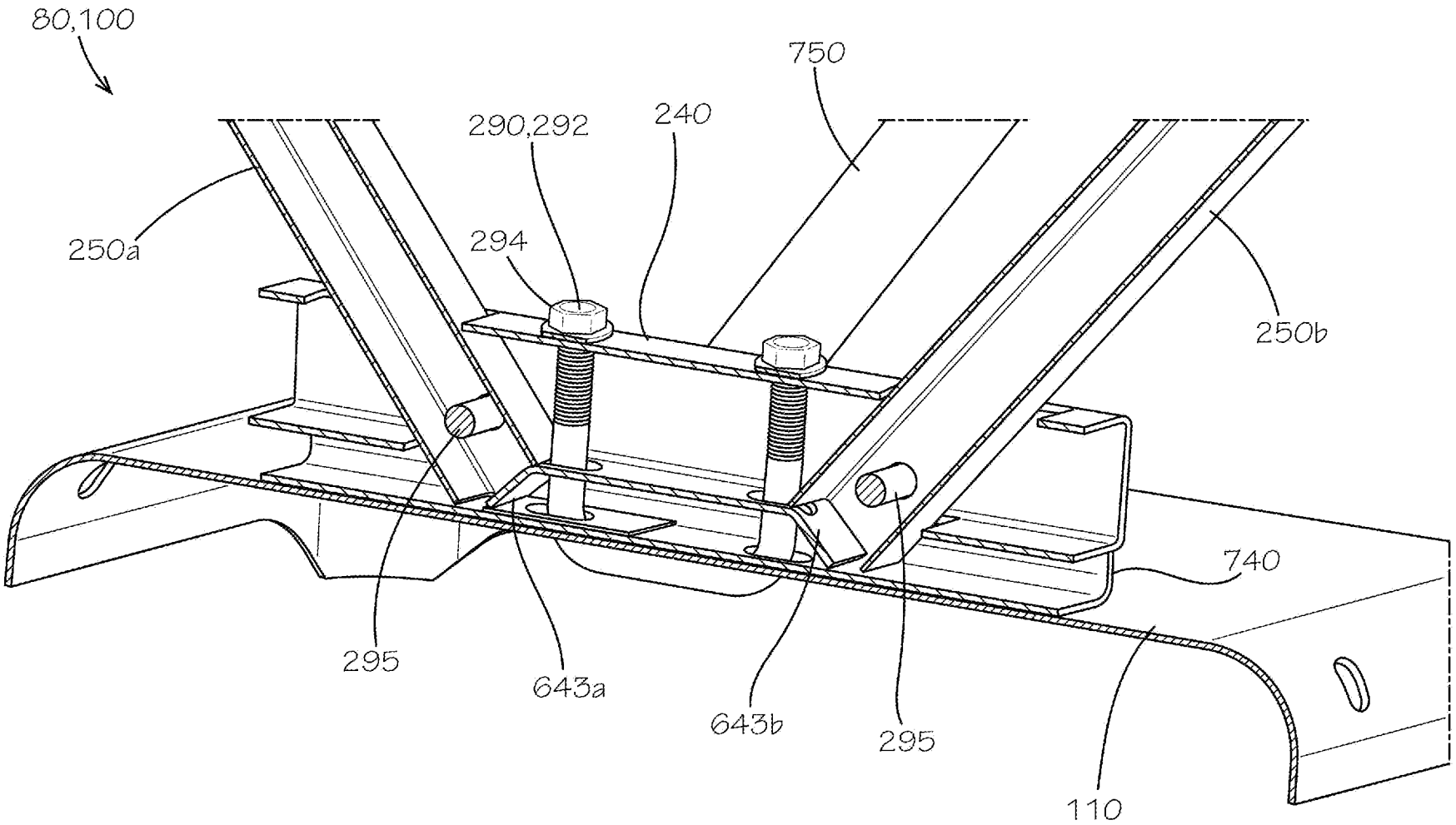
FIG. 7D is a top perspective sectional view of the support device of FIG. 7A taken along line 7C-7C of FIG. 7A.
Figure 7E:
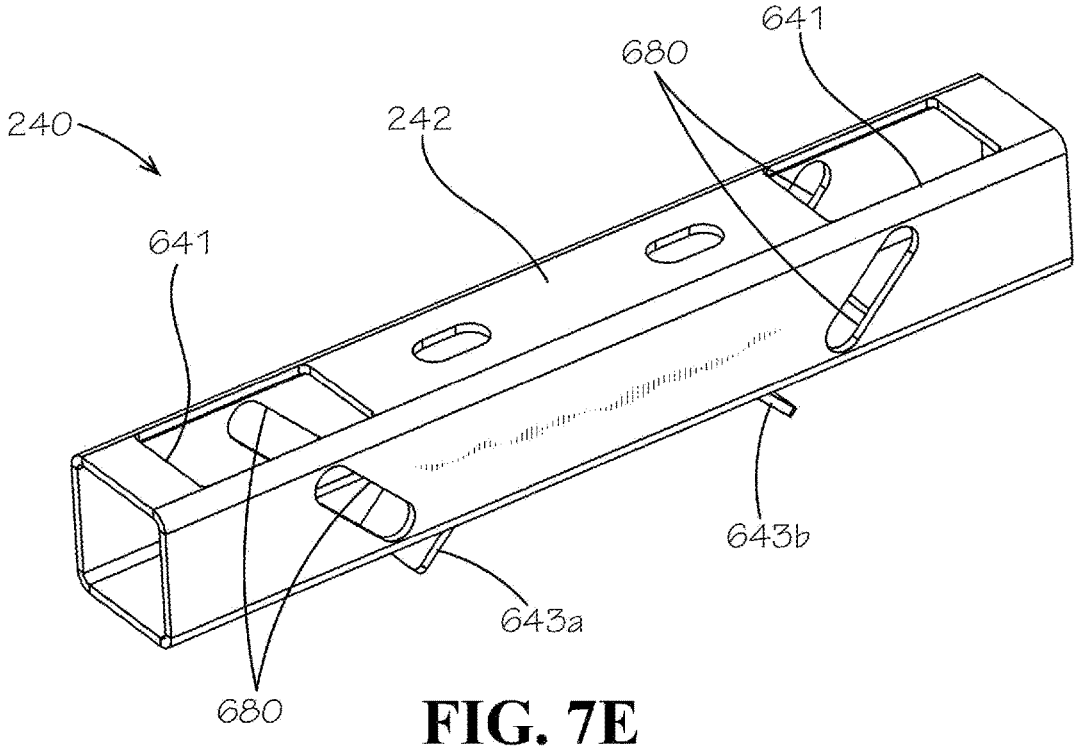
FIG. 7E is a top perspective view of a connector of the support device of FIG. 7A.
Figure 7F:
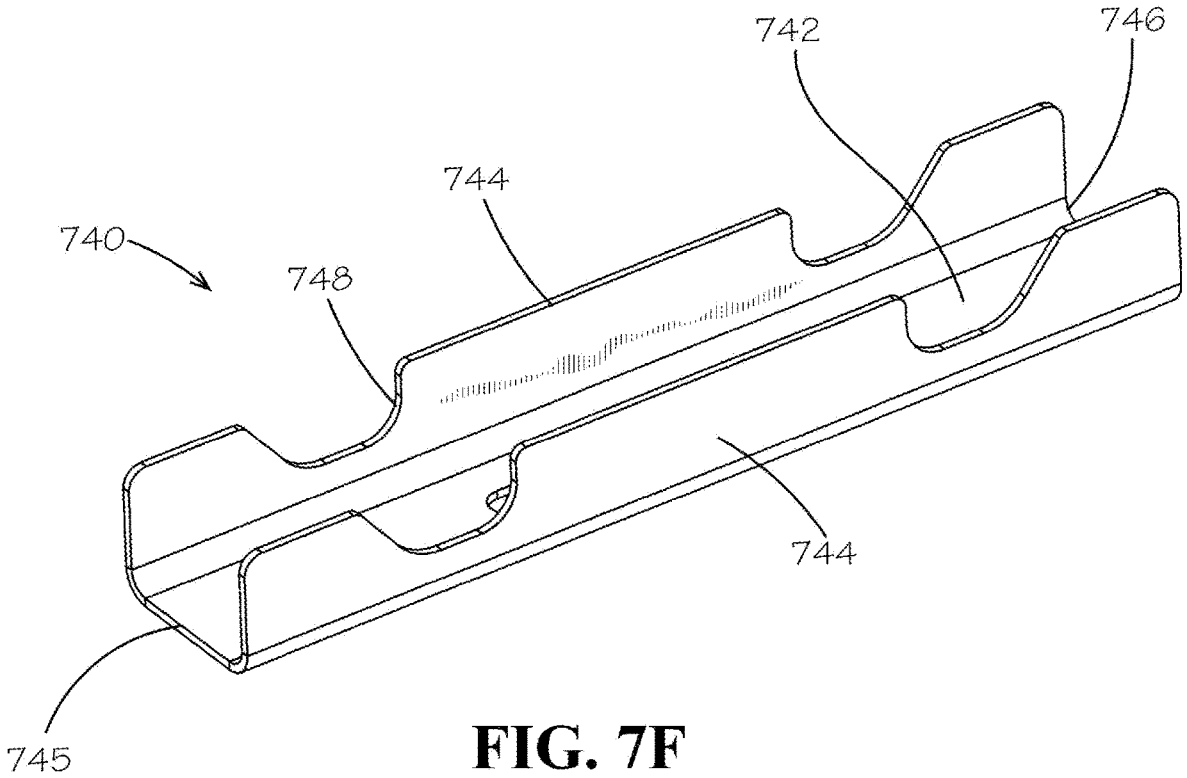
FIG. 7F is a top perspective view of a bracket of the support device of FIG. 7A.

FIGS. 7A-7F are various views of the support device 100 of FIG. 1B in accordance with another aspect of the current disclosure. As shown, the support device 100 can comprise a lateral strut 750, which can extend from the support platform 110 in a transverse, lateral, or Y-axis direction. More specifically, FIG. 7A is a top perspective view, FIG. 7B is a side view, FIG. 7C is a sectional view taken along line 7C-7C of FIG. 7A, FIG. 7D is a top perspective sectional view taken along the same line, FIG. 7E is a perspective view of the connector 240, and FIG. 7F is a perspective view of a bracket 740. As shown, the support device 100 can further comprise the bracket 740, which can be sized and otherwise configured to receive the connector 240, at least in part, and can be positioned between the connector 240 and the support platform 110. The one or more fasteners 290 can engage both the connector 240 and the bracket 740 and couple both the connector 240 and the bracket 740 to the support platform 110. The bracket 740 can define reliefs or openings or notches 748, which can receive and allow free movement of the first end 255 of each strut (shown in FIG. 7C) and, more specifically, the fasteners 295. More generally, the bracket 740 can facilitate distribution of the loading through the struts 250*a,b* across a greater portion of the support platform 110, can further strengthen the support platform 110 itself by increasing resistance to bending of the support platform (by increasing the section modulus based on the added geometry), can help stabilize the connector 240 and struts 250*a,b* by limiting movement of each, and/or by reducing pinch points during use of the support device 100 more generally.

The bracket 740 can define a main portion or main panel 742 and one or more flanges 744, which can be angled with respect to the main panel 742. As shown, the flanges 744 can be angled at 90 degrees with respect to the main panel 742. The bracket 740 can define a first end 745 and a second end 746, which can be distal from the first end 745. In some aspects, as shown, the lateral strut 750 can be positioned between the bracket 740 and the support platform 110. More specifically, an end of the lateral strut 750 can be flattened and bent to match a narrow gap between the bracket 740 and the support platform 110 and can be captured, sandwiched, and secured therein.

Figure 7G:
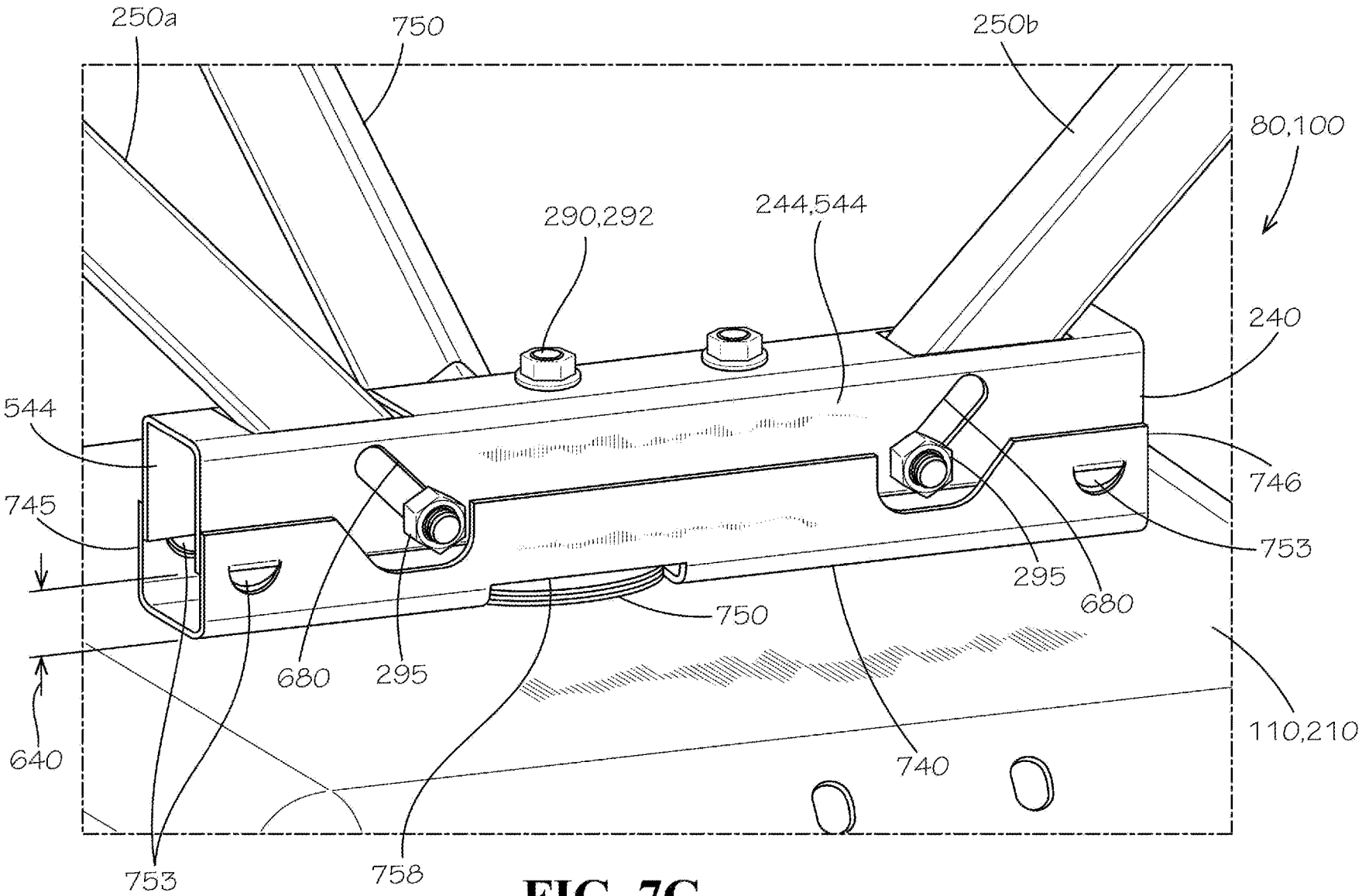
FIG. 7G is a top perspective view of the support device of FIG. 7A comprising the lateral strut in accordance with another aspect of the current disclosure.
Figure 7H:
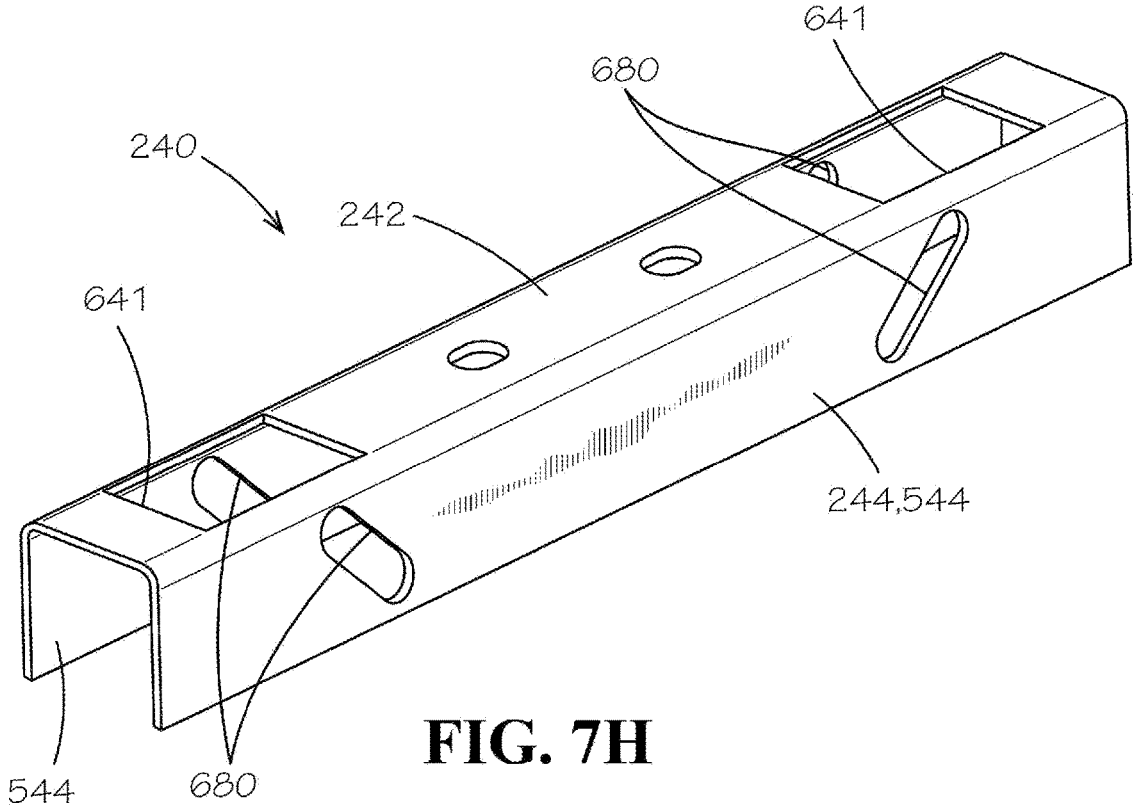
FIG. 7H is a top perspective view of the connector of the support device of FIG. 7G.
Figure 7I:
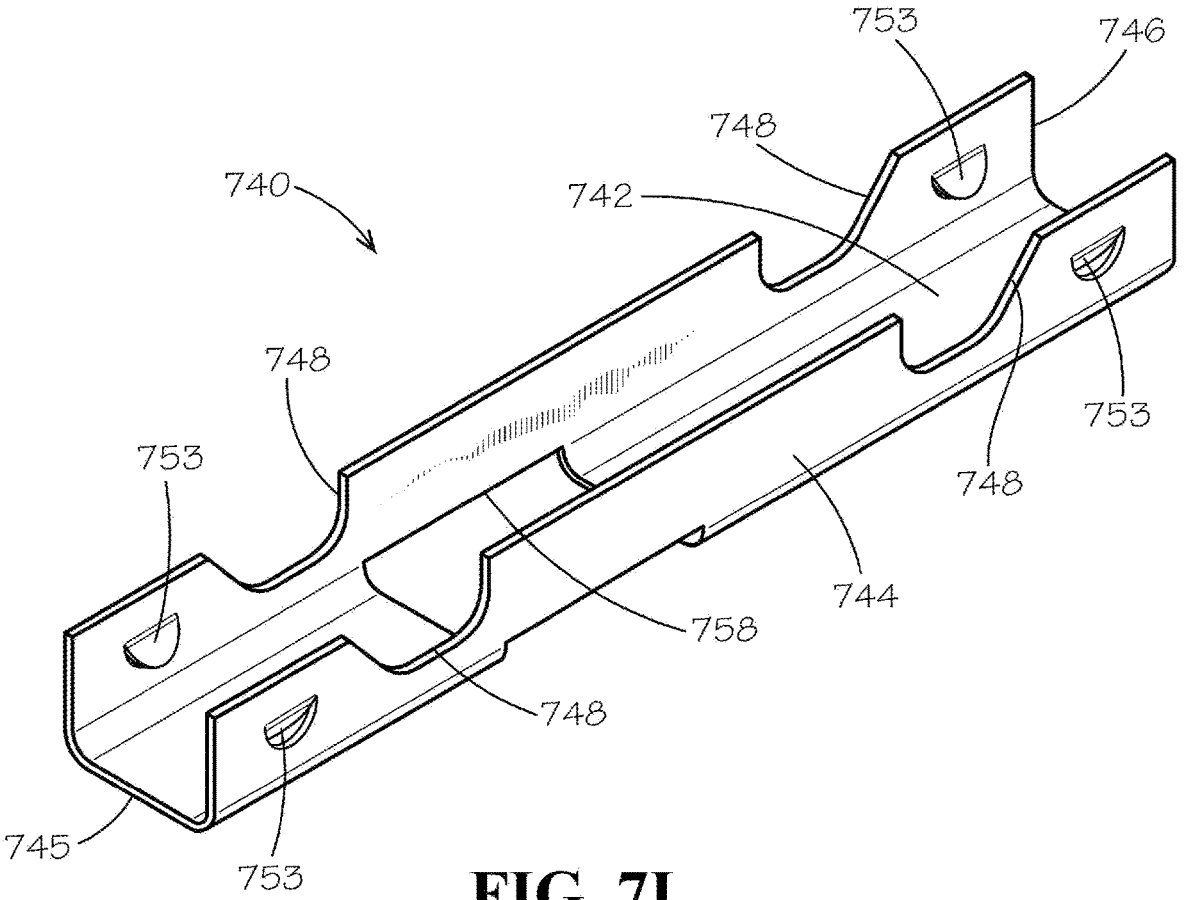
FIG. 7I is a top perspective view of the bracket of the support device of FIG. 7G.

FIGS. 7G-7I are various views of the support device 100 of FIG. 7A comprising the lateral strut 750 in accordance with another aspect of the current disclosure. FIG. 7G is specifically a top perspective view of the support device 100. A cutout 758 in the bracket 740, a top edge of which can be offset from a bottom or outside surface of the main panel 742 thereof, can provide space for and receive a portion of and, more specifically, an end of the lateral strut 750. In some aspects, the lateral strut 750 can otherwise prevent mating contact between the bracket 740 and a top surface of the support platform 110 or, more specifically, the main portion 210 thereof. One or more bent portions or tabs 753 can extend inwardly towards and can support and maintain a vertical position of the connector 240 above the bracket 740 until tightening of the one or more fasteners 290 moves the connector 240 past the tabs 753, which can reduce the connector offset distance 640. As such, the tabs 753 can have a similar purpose as the tabs 643*a,b* (shown in FIG. 6D). Each of the tabs 643*a,b* and the tabs 753 can bias the connector 240 and the struts 250*a,b* in one position so that the connector moves down and the struts 250*a,b* move outward only when the fastener 290 is tightened. As shown, a pair of the tabs 753 can be positioned or defined proximate to each end 745,746 of the bracket 740. The tabs 753 can more specifically support the side walls 544 of the connector 240 defining the side surfaces 244.

The end piece 580 (shown in FIG. 5F) can be positioned in the first end 255 (shown in FIG. 6C) of each of the struts 250*a,b* and can more directly contact the support platform 110. The end pieces 580, which can be made of a different material than the struts 250*a,b*, can in some aspects slide across the support platform 110 more easily than the first ends 255, which can be rough and or can otherwise catch on and/or abrade against the support platform 110. The end piece 580 can be configured to remain in contact with the support platform 110 during use of the support device 100. More specifically, the end piece 580 can be configured to remain in slideable contact with the support platform 110 during use of the support device 100.

As can be seen again here and is described in further detail with respect to FIG. 6D and elsewhere herein, tightening of the fastener 290 can reduce the connector offset distance 640. In some aspects in which the tabs 753 are present, tightening of the fastener 290 can flatten, i.e., unbend, or simply push out the tabs 753 and permit further movement of the connector 240 as desired. Tightening of the fastener 290 can move or adjust a position of one or both of the struts 250*a,b* by moving the fasteners 295 pinned and coupled to the corresponding struts 250*a,b* and to the connector 240. More specifically, such tightening of the fastener 290 can move each strut 250*a,b* and the corresponding fastener 295 along a corresponding aperture 680—or, as shown in FIG. 7H, a pair of apertures—defined in the connector 240. Upon tightening of the fastener 290, the fastener 295 and the first end 255 of the strut 250*a,b* pinned to the connector 240 by the fastener 295 can, more specifically, move away from a centerline 601 (shown in FIG. 6D) of the support device 100. Such movement or adjustment of the position of one or both of the struts 250*a,b* can adjust the fastener offset distance 670 (shown in FIG. 6D), can adjust the angles 257,258 (shown in FIG. 6A), and cause an effective height 650

(shown in FIG. 6A) of the support device 100 to increase and thereby cause the support device 100 to be able to carry or support a greater portion of the weight of the structure 50 (shown in FIG. 1A).

FIG. 7H is a top perspective view of the connector 240 of the support device 100 of FIG. 7G, which in some aspects described in more detail with respect to FIG. 7E. As shown in FIG. 7H, however, the connector 240 need not comprise the lower wall 541 and can, instead, define a U-shaped cross-section.

FIG. 7I is a top perspective view of the bracket 740 of the support device 100 of FIG. 7G, which in some aspects is described in more detail with respect to FIG. 7F. In some aspects, as shown in FIG. 7I, a portion of the material forming the bracket 740 and, more specifically, the one or more flanges 744 thereof can form the tabs 753, which can be bent with respect to the outer surface 244 and can support the side walls 544 of the connector 240. Again, as shown in FIG. 7G, the lateral strut 750 can be positioned between the bracket 740 and the support platform 110. More specifically, an end of the lateral strut 750 can be flattened and can be received within the cutout 758 and/or the previously described narrow gap between the bracket 740 and the support platform 110 and can be captured, sandwiched, and secured therein.

Figure 8:
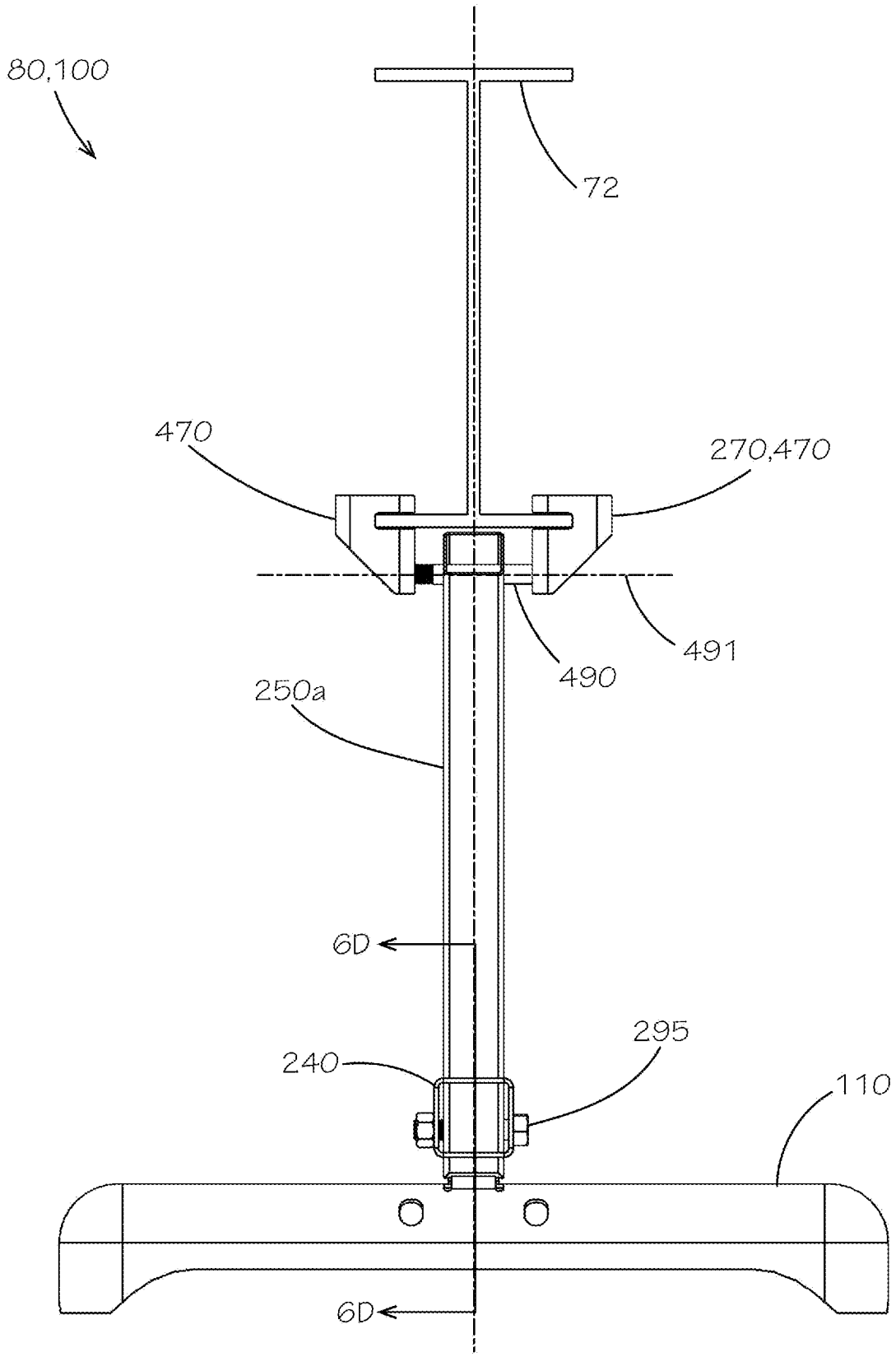
FIG. 8 is an end view of the longitudinal beam of FIG. 1B and the support device of FIG. 6A.

FIG. 8 is an end view of the longitudinal beam 72 of FIG. 1B and the support device 100 of FIG. 6A. As shown, a centerline of the strut 250*a* can be aligned with a centerline of the beam 72. As also shown, the centerline of the strut 250*a* can be aligned with any one or more of a centerline of the connector 240, a centerline of the clamp 270, and a centerline of the support platform 110. As described above, tightening of the fastener 490 along the axis 491 can tend to rotate each of the clamp bodies 470 of the clamp 270. More specifically, a bottom end 575 (shown in FIG. 5A) of the clamp body 470 can be made to rotate inward, which can cause a top end 576 (shown in FIG. 5A) of the clamp body 470 and more, specifically, any of the teeth 578 (shown in FIG. 5A) defined therein, to more securely engage the beam 72. In some aspects, the support device can be positioned under and can support a beam oriented in a direction other than the longitudinal direction such as, for example and without limitation, the beam 75*a* (shown in FIG. 1A) extending in the lateral or Y-axis direction.

Figure 9A:
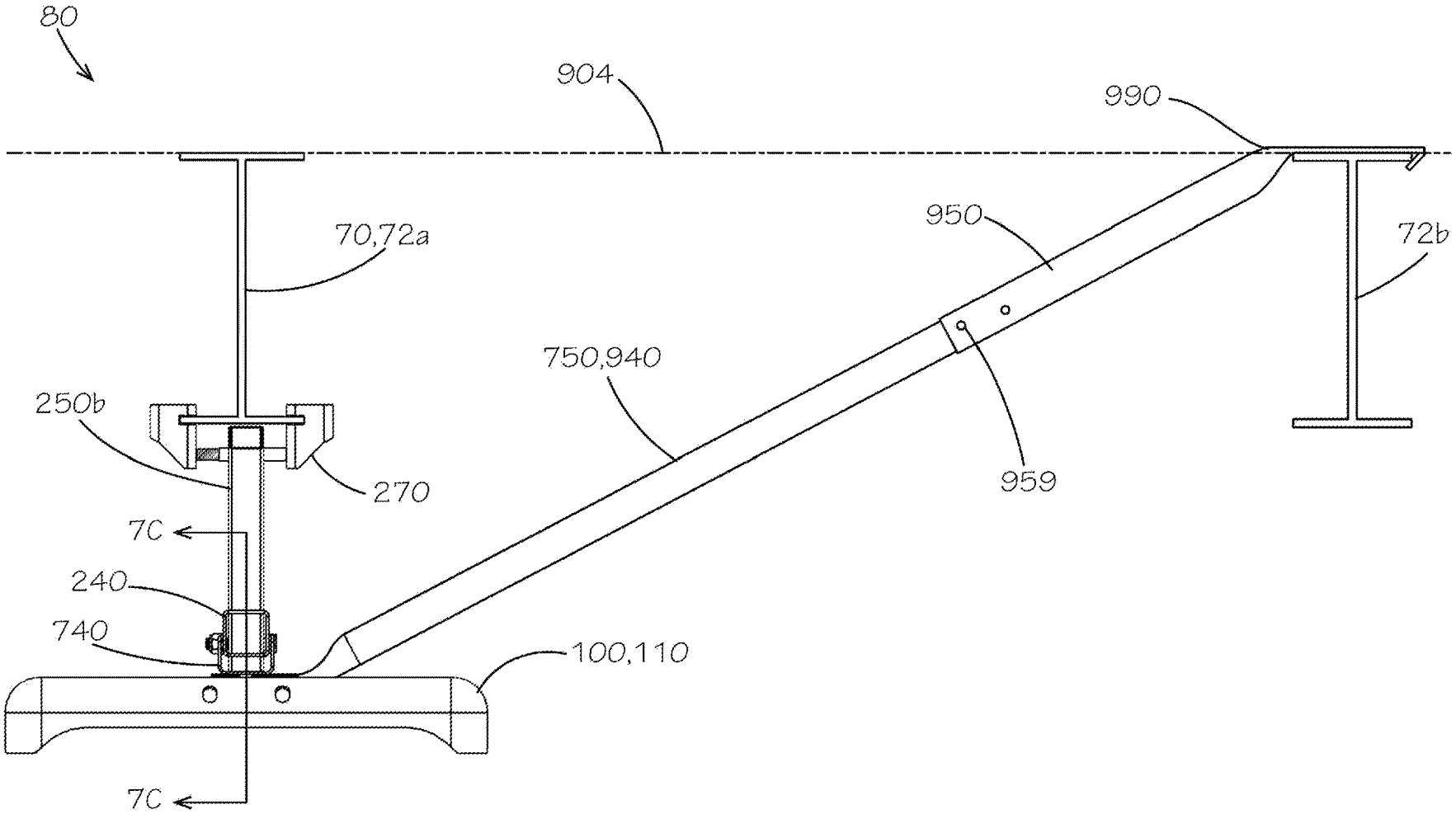
FIG. 9A is an end view of the longitudinal beam of FIG. 1B, which can be a first longitudinal beam, and the support device of FIG. 7A as well as a second longitudinal beam of the base of FIG. 1A and the lateral strut of FIG. 7A tying the second longitudinal beam to the support device, all taken along line 9A-9A of FIG. 9C.
Figure 9B:
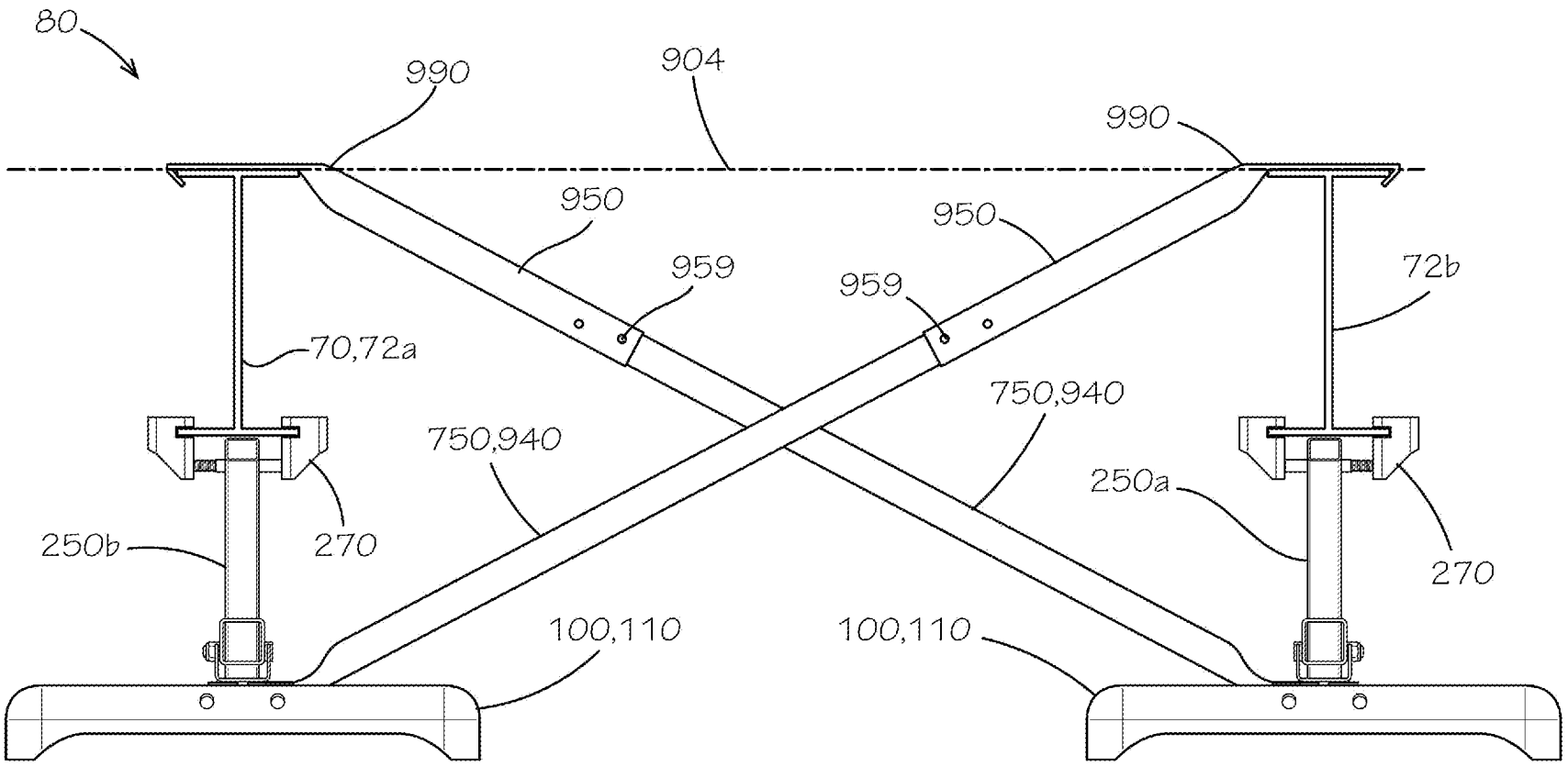
FIG. 9B is an end view of the first longitudinal beam and the second longitudinal beam of FIG. 9A as well as the support device of FIG. 7A, which can be a first instance of the support device, as well as a second instance of the support device of FIG. 7A supporting the second longitudinal beam and a second lateral strut of FIG. 7A tying the first longitudinal beam to the second support device, all taken along line 9B-9B of FIG. 9C.
Figure 9C:
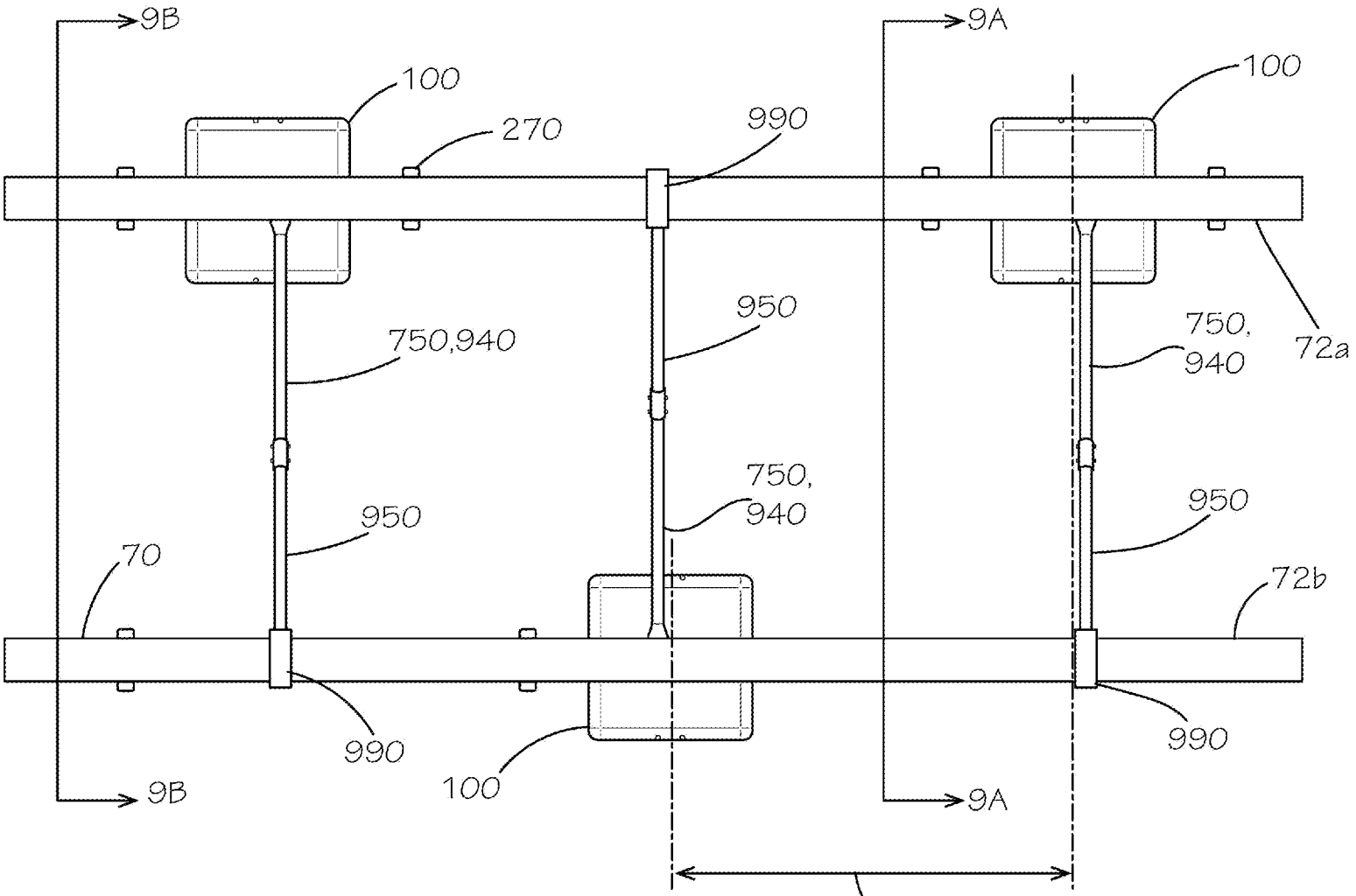
FIG. 9C is a top view of the first longitudinal beam and the second longitudinal beam of FIG. 9A as well as a plurality of the support devices of FIG. 7A, with any cross members removed for clarity.

FIG. 9A is an end view of the longitudinal beam 72 of FIG. 1B, which can be a first longitudinal beam 72*a*, and the support device 100 of FIG. 7A as well as a second longitudinal beam 72*b* of the base 60 of FIG. 1A and the lateral strut 750 of FIG. 7A tying the second longitudinal beam 72*b* to the support device 100, all taken along line 9A-9A of FIG. 9C. A length of the struts 250*a,b* and any other dimension disclosed herein can be shorter or longer, proportionally with respect to other dimensions, than shown in this or any other figure. In FIGS. 9A and 9B, each of the struts 250*a,b* defines a shorter length than shown in select other figures such as FIG. 8. As shown, the lateral strut 750 can comprise a base portion 940, an extension portion 950, and a fastener 990, which can comprise or can be a tie-down strap or hook and can be configured to hook, as shown, or otherwise secure the lateral strut 750 to a beam such as the beam 72*b*. The base portion 940 and the extension portion 950 can be joined to each other with one or more fasteners 959. In some aspects, the lateral strut 750 can comprise a telescopic design in which the extension portion 950 rides within or about the base portion 940. In some aspects, the lateral strut 750 can be otherwise adjustable in a longitudinal direction thereof. The beams 72*a,b* and, more generally, the frame 70 (shown in FIG. 1A) can be aligned along a datum line 904 in cross-section and can be aligned within a corresponding datum plane. The support device 100, and more specifically, the struts 250*a,b* thereof can stabilize the frame 70 with respect to the ground 40 (shown in FIG. 6A) in the longitudinal or X-axis direction, and the lateral strut 750 can stabilize the frame 70 in a lateral or Y-axis direction.

FIG. 9B is an end view of the first longitudinal beam 72*a* and the second longitudinal beam 72*b* of FIG. 9A as well as the support device 100 of FIG. 7A, which can be a first instance of the support device 100, as well as a second instance of the support device 100 of FIG. 7A supporting the second longitudinal beam 72*b* and a second lateral strut 750 of FIG. 7A tying the first longitudinal beam 72*a* to the second support device 100, all taken along line 9B-9B of FIG. 9C.

FIG. 9C is a top view of the first longitudinal beam 72*a* and the second longitudinal beam 72*b* of FIG. 9A as well as a plurality of the support devices 100 of FIG. 7A, with any cross members removed for clarity. By alternating or switching an orientation of the support devices 100 in a longitudinal or X-axis direction of the frame 70, the frame 70 and, more generally, the structure 50 (shown in FIG. 1A) can be adequately supported without the use of static piers (e.g., columns formed from concrete and/or wooden blocks and shims). Adjacent support devices 100 of the plurality of the support devices 100 can be spaced, on a center-to-center basis, at a spacing 970, which can be based on the loads expected and industry and/or regulatory standards such as, e.g., NCSBCS A 225.1, 1994 edition, Manufactured Home Installations from the National Conference of States on Building Codes and Standards (NCSBCS) and the document Model Manufactured Home Installation Standards, 2003 edition, from the Federal Manufactured Housing Consensus Committee.

Figure 10A:
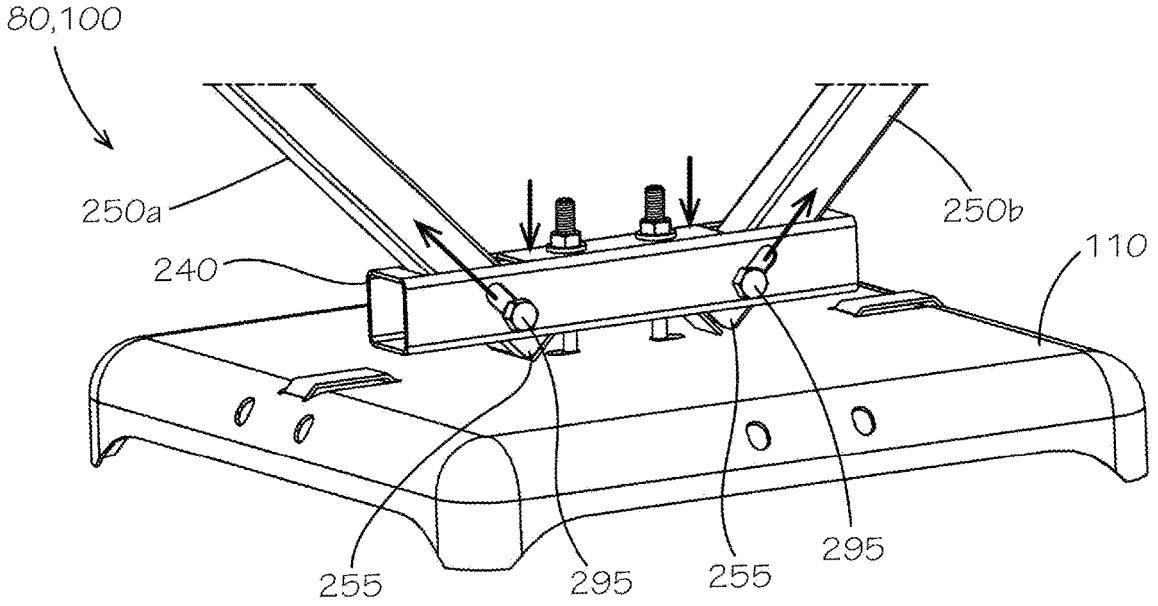
FIG. 10A is a top perspective view of the support device of FIG. 6A with the connector of the support device in a raised position and the support device in an unloaded configuration.

FIG. 10A is a top perspective view of the support device 100 of FIG. 6A with the connector 240 of the support device 100 in a raised position and the support device 100 in an unloaded configuration. As shown, the support device 100 can be configured such that downward movement of the connector 240 causes outward movement of the respective first ends 255 of the struts 250*a,b*, a horizontal component of which can effectively increase the effective height 650 (shown in FIG. 6A) of the support device as measured between the support platform 110 and the beam 72 (or as captured by any other equivalent measurement). The effective height 650 can be increased because of the orientation of the slot and the rigidity of each strut 250 by which such outward movement can cause the strut 250, which can define a fixed length, to "stand up" straighter (in other words, increasing the angle 258 shown in FIG. 6A). Conversely, the support device 100 can be configured such that upward movement of the connector 240 causes inward movement of the respective first ends 255 of the struts 250*a,b*, a horizontal component of which can effectively decrease the effective height 650 or any other equivalent measurement. The effective height 650 can be increased because of the orientation of the slot and the rigidity of each strut 250 by which such inward movement can cause the strut 250 to "stand up" less (in other words, decreasing the angle 258). The downward or upward movement of the connector 240 can be effected by tightening or loosening of the fastener 290 (e.g., by rotation of the second portion 294 with respect to the first portion 292 clockwise or counterclockwise in the case of standard right-hand screw threads). Because of the sufficiently tight grip between the clamp 270 and the beam 72*a,b*, the connections between the struts 250*a,b* and the beam

72*a,b* can be made to not move during any of the aforementioned adjustments. In some aspects, however, such connections at the clamps 270 can be loosened and resecured as desired (for example, if the initial placement of any of the clamps 270 is not ideal).

Figure 10B:
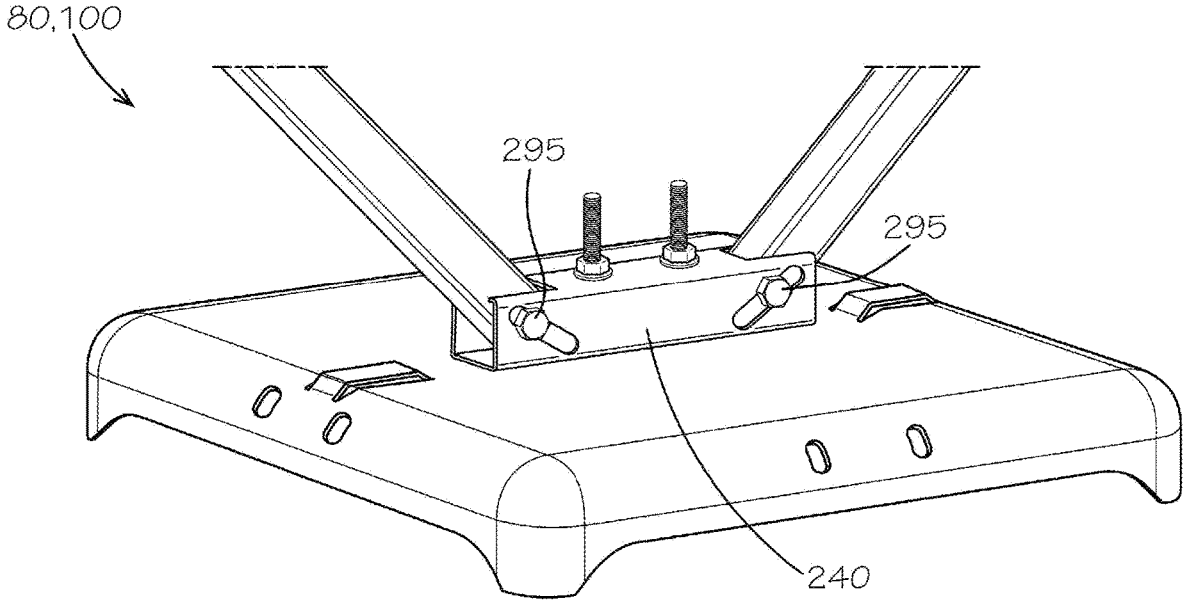
FIG. 10B is a top perspective view of the support device of FIG. 6A with the connector of the support device in a lowered position and the support device in a loaded configuration.

FIG. 10B is a top perspective view of the support device 100 of FIG. 6A with the connector 240 of the support device 100 in a lowered position and the support device 100 in a loaded configuration, i.e., after downward movement of the connector 240 resulting in outward movement of the struts 250*a,b*. In some aspects, as shown, the openings 641 (shown in FIG. 7E) can extend to an edge of the connector 240. More specifically, the connector 240 can be truncated at the ends 245,246 (shown in FIG. 7C) and can be extended only far enough to be able to define the apertures 680 (shown in FIG. 7E).

Note that various aspects of the support system 80 either form triangle-shaped structures or a near-triangle shape and therefore will resist deformation to the point of failure of the materials and components forming those structures. The support systems 80 disclosed herein are thus inherently rigid and stable, and even where the shape is not perfectly triangle (due to the offset distance 670 shown in FIG. 6D, for example), such a shape facilitates adjustment of the support system 80 and even loading and support of the frame 70.

Figure 11A:
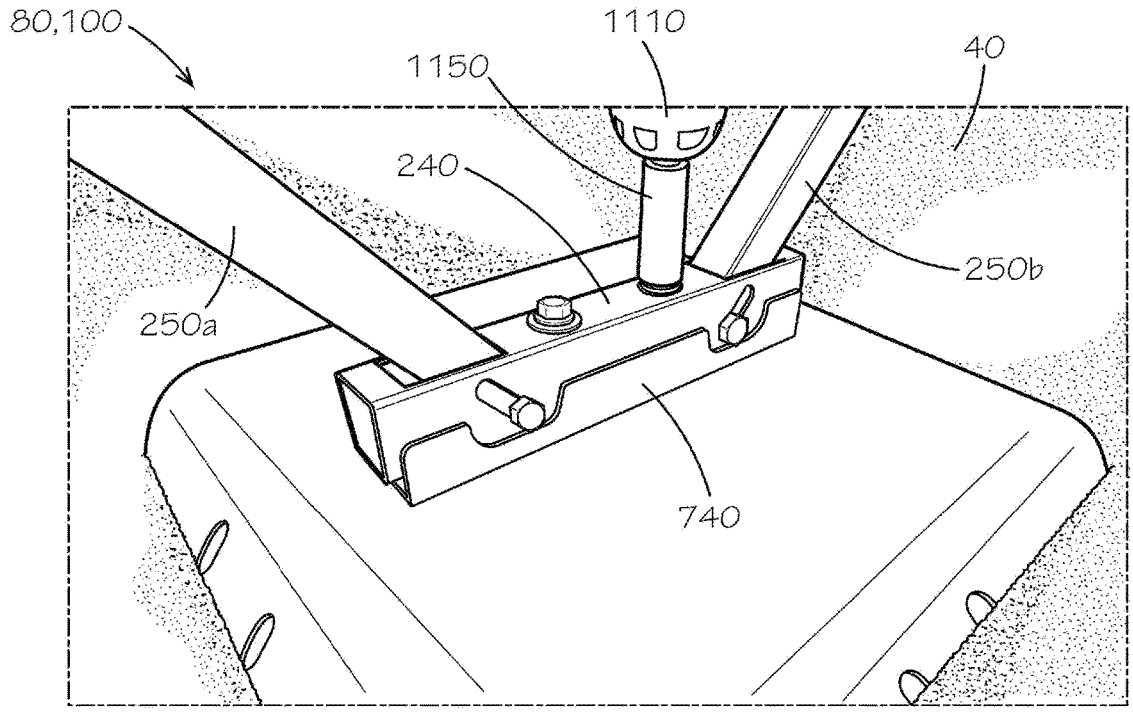
FIG. 11A is a top perspective view of the support device of FIG. 7A during testing of same with the connector of the support device in a raised position and the support device in a partially loaded configuration under which 1,000 pounds of force has been applied.

FIG. 11A is a top perspective view of the support device 100 of FIG. 7A during testing of same with connector 240 of the support device 100 in a raised position and the support device 100 in a partially loaded configuration under which 1,000 pounds of force has been applied. A tool 1110, which can be positioned above the fastener as shown, can be coupled to a tool bit 1150 (e.g., a hex-shaped socket) and is shown beginning to tighten one side of the fastener 290. The tool 1110 can be used to alternately tighten one and then the other side of the fastener 290. In some aspects, as shown, the tool 1110 can be a power tool, which can be powered by pneumatic, electrical, or another corded or cordless power source. In some aspects, a mechanical tool 1110 with sufficient mechanical leverage by a user can be used to adjust the fastener 290. In some aspects, a torque setting on the tool 1110 can be adjusted so that each of the support devices is "loaded" to the same degree instead of a user guessing by other means or using a much more crude method of piling concrete and/or wooden blocks and/or driving shims to fill in the remaining gaps.

Figure 11B:
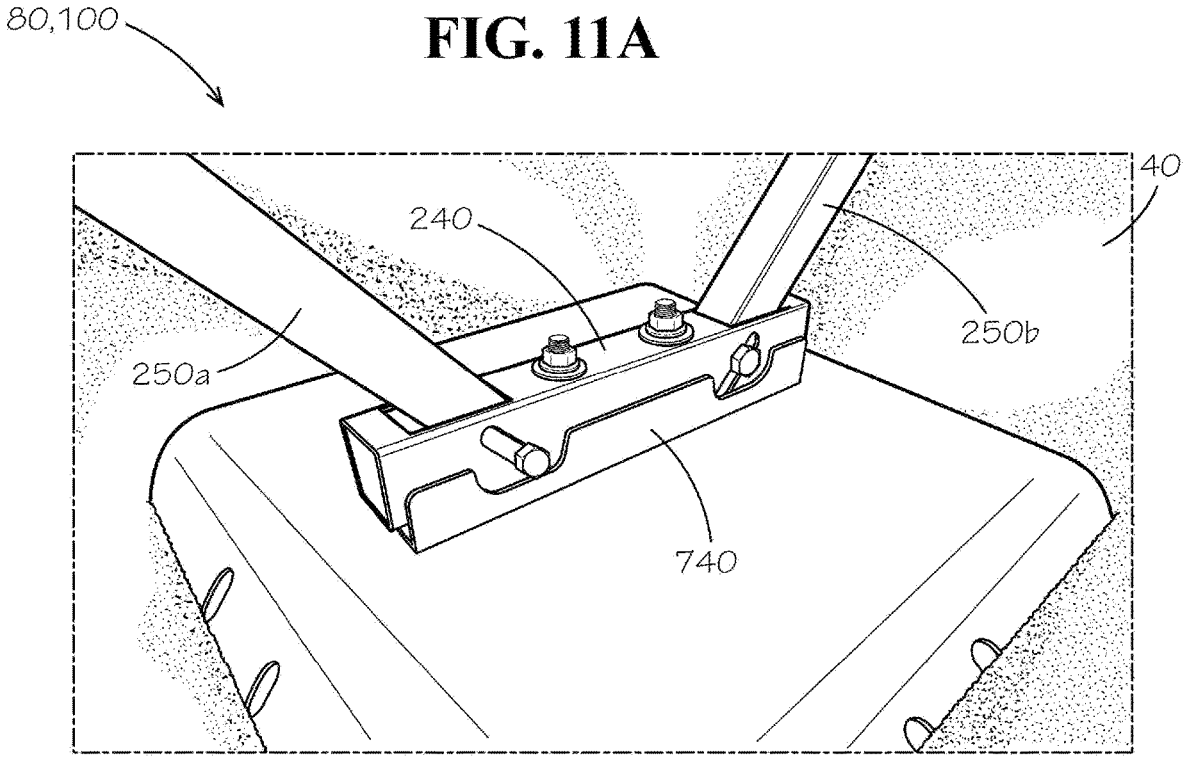
FIG. 11B is a top perspective view of the support device of FIG. 7A during testing of same with the connector of the support device in a lowered position and the support device in a loaded configuration under which 1,000 pounds of force has been applied.

FIG. 11B is a top perspective view of the support device 100 of FIG. 7A during testing of same with the connector 240 of the support device 100 in a lowered position and the support device 100 in a loaded configuration under which 1,000 pounds of force has been applied. As shown, the first end 255 of each of the struts can be made to move outward from a center of the support device 100.

Figure 11C:
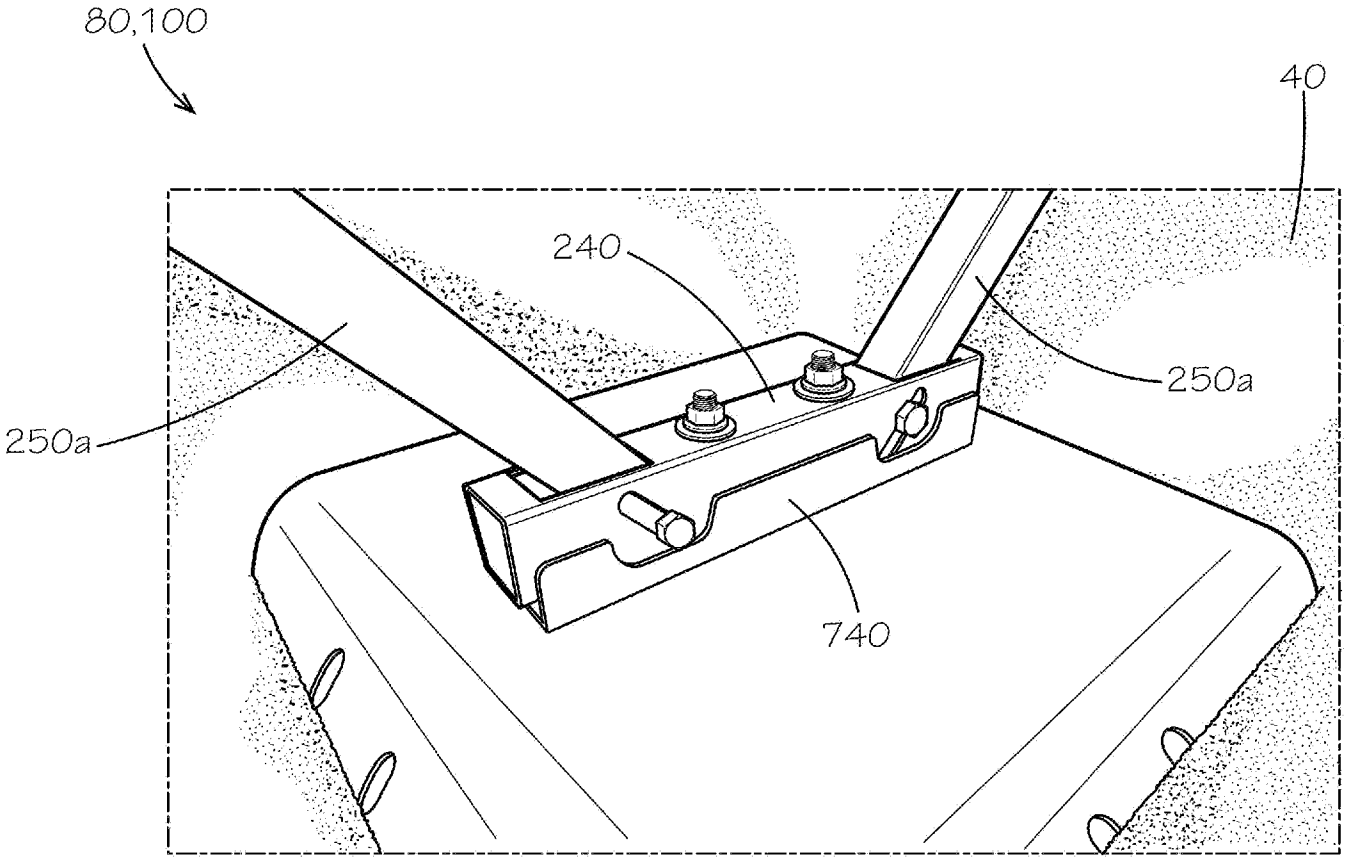
FIG. 11C is a top perspective view of the support device of FIG. 7A during testing of same with connector of the support device in a lowered position and the support device in a loaded configuration under which 11,000 pounds of force has been applied.

FIG. 11C is a top perspective view of the support device 100 of FIG. 7A during testing of same with the connector 240 of the support device 100 in a lowered position and the support device 100 in a loaded configuration under which 11,000 pounds of force has been applied. As shown, the load transmitted through the struts 250*a,b* can be distributed not only through two points of connection resulting from the two struts 250*a,b* but also can be distributed and also reinforced by the bracket 740 shown positioned between the connector 240 and the support platform 110.

Figure 12:
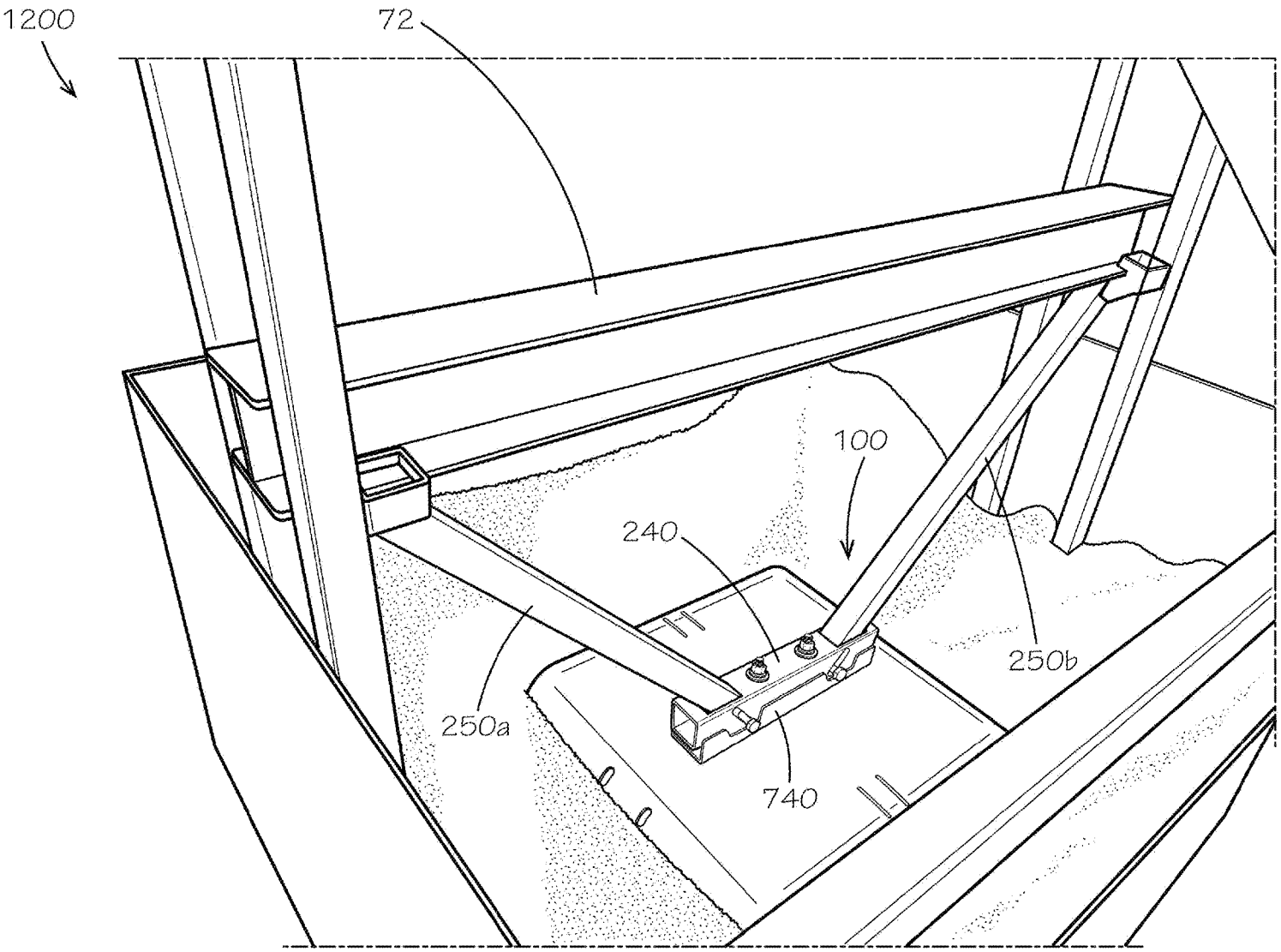
FIG. 12 is a top perspective view of a compressive testing apparatus shown with the support device of FIG. 7A secured to a simulated version of the beam 72.

FIG. 12 is a top perspective view of a compressive testing apparatus 1200 shown with the support device 100 of FIG. 7A secured to a simulated version of the beam 72. In some aspects, the support system 80 can support the structure 50 when the structure 50 weighs at least 1,000 pounds of force per square foot. In some aspects, the support system 80 can support the structure 50 when the structure 50 weighs at least 4,000 pounds of force per square foot.

A method of using the support system 80 can comprise any one or more of the following steps, in or out of the following order:

1. Towing the frame 70 and, more generally, the base 60 and the structure 50 to the erection site, e.g., on wheels.
2. Temporarily lowering and supporting the structure 50 on static piers.
3. Placing one or more support devices 100 on the ground 40 beneath the frame 70.
4. Adjusting each of the one or more support devices 100 to assume or bear a share of the load of the structure 50.
5. Balance the load between the one or more of the support devices 100 by adjusting the "loading" of one or more of the support devices 100.
6. Previously adjusting the position of the frame 70 for height.
7. Distributing adjacent support devices 100 of the plurality of the support devices 100 at the spacing 970 and making such spacing consistent.
8. Positioning support devices at the end of each beam 72 and at the spacing 970 therebetween.
9. Adding additional support devices where additional support is desired based on the unique characteristics of the structure 50.
10. Removing all static piers from under the frame 70 so that only the support devices 100 and, more generally, the support system 80 comprising same remains.
11. Installing ground anchors (not shown) as desired and securing one or more of the support devices 100 to same.
12. Assembling one or more of the support devices 100 on-site (e.g., assembly the struts 250*a,b*, the connector 240, and/or the support platform 110 to each other.
13. Fixing in a stationary position the support platform 110 a longitudinal direction and/or a lateral direction of the support system 80 once engaged with the ground 40.
14. Clamping the claim 270 to the beam 72*a,b*.
15. Tightening the fastener 490 to engage the clamp 270 with the beam 72*a,b*, the clamp body 470 rotating in the process.
16. Adjusting the support device 100 to adjust the effective height 650 thereof to increase or decrease loading on the support device 100 by adjusting the fastener 290 with the tool 1110.
17. Engaging teeth of the clamp body 470 in a direction substantially normally with a horizontal surface of the flange 174 of the beam 72*a,b*.
18. Adjusting the fastener 290 to adjust a position of the connector 240, which can comprise rotating the second portion 294 of the fastener 290 with respect to the first portion 292 of the fastener 290.
19. Pushing up a diagonal slot (e.g., the aperture 680) defined in the connector 240 the fastener 295 securing the first end 255 of the strut 250.
20. Supporting the first end 255 of the strut 250 with the tab 643*a,b* of the connector 240.
21. Bending the tab 643*a,b* of the connector during tightening of the fastener 290 and adjustment of the support device 100.
22. Adjusting the tightness or fastening torque of the fastener 290 with the tool 1110, in which case the tool 1110 can include the tools disclosed herein including a torque wrench.

23. Determining a fastening torque value, which can be a predetermined and/or target fastening torque value, of each of the one or more fasteners 290 for each of the plurality of support devices 100.

24. Adjusting and balancing the torque values of fasteners 290, which can be made to fall within a predetermined and/or target fastening torque range, with the tool 1110, which can be the torque wrench to provide an indication of the load being assumed by the strut 250*a, b.*

25. Adjusting one or more of plurality of the support devices 100 after time is provided for settling of the structure 50 or after any significant change in loading of the structure.

The support platform 110, the struts 250*a.b*, the lateral strut 750, and other components of the support systems 80 and the structure 50 can be formed from a sheet metal material such as, for example and without limitation, steel.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A support device for a premanufactured structure, the support device comprising:

a support platform;

a connector coupled to the support platform with a device fastener, the device fastener configured to adjust, upon tightening, a connector offset distance defined between the connector and the support platform; and a plurality of struts coupled to the connector and configured to be coupled to the premanufactured structure, each of the plurality of struts coupled to the connector and configured to transfer a portion of a weight of the premanufactured structure to the support platform via the connector.

2. The support device of claim 1, further comprising a clamp coupled to each of the plurality of struts and to a load-carrying portion of a frame of the premanufactured structure, the clamp configured to transfer a portion of the weight of the premanufactured structure to a corresponding strut of the plurality of struts.

3. The support device of claim 2, wherein the clamp comprises two clamp bodies, the clamp bodies coupled to each other with a clamp fastener and positioned on and engaging with opposite sides of the load-carrying portion of the frame of the premanufactured structure.

4. The support device of claim 3, wherein at least one clamp body of the two clamp bodies is configured to rotate upon tightening of the clamp fastener and to more securely engage the load-carrying portion of the frame of the premanufactured structure.

5. The support device of claim 3, wherein at least one clamp body of the two clamp bodies is monolithic.

6. The support device of claim 3, wherein at least one clamp body of the two clamp bodies defines an engagement slot configured to engage the load-carrying portion of the frame of the premanufactured structure.

7. The support device of claim 6, wherein the engagement slot of the at least one clamp body of the two clamp bodies defines one or more teeth.

8. The support device of claim 1, where the device fastener comprises a U-bolt.

9. The support device of claim 1, where the device fastener extends through each of the connector and the support platform.

10. The support device of claim 1, wherein an axis of the device fastener is angled with respect to a main portion of the support platform.

11. The support device of claim 10, wherein the axis of the device fastener is angled 90 degrees with respect to the main portion of the support platform.

12. The support device of claim 1, wherein a first end of each of the plurality of struts comprises an end piece secured to the first end.

13. The support device of claim 1, wherein the device fastener is further configured to adjust, upon tightening, an effective height of the support device.

14. The support device of claim 1, wherein each of the plurality of struts is coupled to the connector at an angle with respect to each of a vertical direction and a horizontal direction of the support device, the support device configured such that tightening the device fastener adjusts the angle at which each of the plurality of struts is coupled to the connector.

15. The support device of claim 1, wherein:

a first strut of the plurality of struts is coupled to the connector with a first strut fastener, the first strut fastener slideably received within a pair of first apertures defined in the connector, the first strut slideably moveable with respect to the connector along a centerline of each of the pair of first apertures; and a second strut of the plurality of struts is coupled to the connector with a second strut fastener, the second strut fastener slideably received within a pair of second apertures defined in the connector, the second strut slideably moveable with respect to the connector in a longitudinal direction of each of the pair of first apertures.

16. The support device of claim 15, wherein an aperture angle of each of the pair of first apertures is more than or equal to 30 degrees and less than or equal to 60 degrees.

17. The support device of claim 1, where the support platform defines a receiver, the receiver defining a slot configured to receive a strap.

18. The support device of claim 1, wherein the connector comprises a plurality of tabs configured to help maintain a position of the connector in a vertical direction before and during tightening of the device fastener, each of the plurality of tabs configured to support a first end of a corresponding strut of the plurality of struts.

19. The support device of claim 1, further comprising a bracket positioned between the support platform and the connector, the bracket configured to help maintain a position of the connector in at least one of a horizontal direction and a vertical direction.

20. The support device of claim 19, wherein the bracket comprises a plurality of tabs configured to help maintain a position of the connector in a vertical direction before and during tightening of the device fastener.

21. A support system comprising:

a plurality of support devices configured to fully support a weight of a premanufactured structure, each of the plurality of support devices comprising:

a support platform;

a connector coupled to the support platform with a device fastener, the device fastener configured to adjust, upon tightening, a connector offset distance defined between the connector and the support platform; and a plurality of struts coupled to the connector and configured to be coupled to the premanufactured structure.

22. The support system of claim 21, wherein at least one of the plurality of support devices further comprises a clamp coupled to each of the plurality of struts of the at least one of the plurality of support devices and to a load-carrying portion of a frame of the premanufactured structure, the clamp of the at least one of the plurality of support devices configured to transfer a portion of the weight of the premanufactured structure to a corresponding strut of the plurality of struts of the at least one of the plurality of support devices.

23. The support system of claim 22, wherein the frame of the premanufactured structure comprises a beam, the beam comprising a web and a flange extending from the web, the clamp secured to the flange.

24. The support system of claim 21, wherein at least one of the plurality of support devices further comprises a lateral strut secured to the premanufactured structure in a direction angled with respect to a strut of the plurality of struts of the at least one of the plurality of support devices and configured to maintain a position of the premanufactured structure with respect to the at least one of the plurality of support devices.

25. The support system of claim 24, wherein the lateral strut is adjustable.

26. The support system of claim 25, wherein the lateral strut is telescopic.

27. The support system of claim 24, wherein the lateral strut is secured to a frame of the premanufactured structure with a fastener configured to hook the lateral strut to the frame.

28. A method of using a support system for a premanufactured structure, the method comprising:

placing a support device of the support system on ground beneath a load-carrying portion of a frame of the premanufactured structure, the support device comprising:

a support platform;

a connector coupled to the support platform with a device fastener;

a plurality of struts coupled to the connector; and adjusting an effective height of the support device to increase or decrease loading on the support device by adjusting, upon tightening of the device fastener, a connector offset distance defined between the connector and the support platform.

29. The method of claim 28, wherein:

a first strut of the plurality of struts is coupled to the connector with a first strut fastener, the first strut fastener slideably received within a pair of first apertures defined in the connector, the first strut slideably moveable with respect to the connector along a centerline of each of the pair of first apertures;

a second strut of the plurality of struts is coupled to the connector with a second strut fastener, the second strut fastener slideably received within a pair of second apertures defined in the connector, the second strut slideably moveable with respect to the connector in a longitudinal direction of each of the pair of first apertures; and adjusting the support device comprises:

moving, upon tightening of the device fastener, the first strut fastener along the centerline of each of the pair of first apertures; and moving, upon tightening of the device fastener, the second strut fastener along the centerline of each of the pair of second apertures.

30. The method of claim 28, wherein adjusting the support device comprises tightening the device fastener with a tool positioned above the connector.

31. The method of claim 28, further comprising increasing a fastening torque of the device fastener to a value sufficient to indicate loading of the support device by the frame of the premanufactured structure.

32. The method of claim 28, further comprising balancing a fastening torque of the device fastener with a fastening torque of a device fastener of a second support device of the support system.

33. The method of claim 28, wherein each of the plurality of struts is coupled to the connector at an angle with respect to each of the vertical and the horizontal, wherein adjusting the support device comprises adjusting the angle at which each of the plurality of struts is coupled to the connector.

* * * * *